US010858904B2

(12) United States Patent
Yousef et al.

(10) Patent No.: US 10,858,904 B2
(45) Date of Patent: Dec. 8, 2020

(54) ROTATING CONTROL DEVICE HAVING AN ANTI-ROTATION LOCKING SYSTEM

(71) Applicant: Nabors Drilling Technologies USA, Inc., Houston, TX (US)

(72) Inventors: Faisal Yousef, Houston, TX (US); Tommy Vu, Houston, TX (US); Brian Ellis, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 35 days.

(21) Appl. No.: 16/054,965

(22) Filed: Aug. 3, 2018

(65) Prior Publication Data

US 2020/0040688 A1 Feb. 6, 2020

(51) Int. Cl.

| | |
|---|---|
| ***E21B 4/00*** | (2006.01) |
| ***E21B 23/02*** | (2006.01) |
| ***E21B 33/06*** | (2006.01) |
| ***E21B 33/08*** | (2006.01) |
| *E21B 34/16* | (2006.01) |

(52) U.S. Cl.

CPC ..... *E21B 33/085* (2013.01); *E21B 4/003* (2013.01); *E21B 23/02* (2013.01); *E21B 33/061* (2013.01); *E21B 34/16* (2013.01)

(58) Field of Classification Search

CPC ..... E21B 4/003; E21B 23/02; E21B 33/061; E21B 33/085

See application file for complete search history.

(56) References Cited

U.S. PATENT DOCUMENTS

| | | | | |
|---|---|---|---|---|
| 3,621,912 | A * | 11/1971 | Wooddy, Jr. | E21B 33/085 166/340 |
| 4,363,357 | A * | 12/1982 | Hunter | E21B 33/085 166/84.3 |
| 5,634,671 | A | 6/1997 | Watkins | |
| 7,165,610 | B2 * | 1/2007 | Hopper | E21B 33/085 166/84.1 |
| 7,174,956 | B2 | 2/2007 | Williams et al. | |
| 7,198,098 | B2 | 4/2007 | Williams | |
| 7,334,633 | B2 | 2/2008 | Williams et al. | |
| 7,726,416 | B2 * | 6/2010 | Williams | E21B 33/085 175/195 |
| 7,766,100 | B2 * | 8/2010 | Williams | E21B 33/085 166/85.5 |
| 7,798,210 | B1 * | 9/2010 | Pruitt | E21B 33/085 166/84.1 |

(Continued)

*Primary Examiner* — Matthew R Buck

(57) ABSTRACT

A rotating control device (RCD) having an anti-rotation locking system for restricting rotation of a bearing assembly housing of the RCD comprises an RCD housing operable with a blowout preventer, and a bearing assembly operable to be received within the RCD housing and comprising a stationary bearing housing. The bearing assembly can be configured to receive and engage with and seal a pipe of a drill string of a drill rig. The stationary bearing housing can have secured thereto a locking ring. The anti-rotation locking system of the RCD can further comprise one or more anti-rotation devices moveable between a locked position and an unlocked position. The anti-rotation device(s) are operable to engage the locking ring, when in the locked position, to lock the stationary bearing housing to the RCD housing independent of the rotational position of the stationary bearing housing relative to the RCD housing.

19 Claims, 16 Drawing Sheets

(56) References Cited

U.S. PATENT DOCUMENTS

| | | | | |
|---|---|---|---|---|
| 7,874,353 | B2 | 1/2011 | Williams | |
| 8,256,507 | B2 | 9/2012 | Williams | |
| 8,322,432 | B2 * | 12/2012 | Bailey | E21B 33/085 166/344 |
| 8,991,484 | B2 * | 3/2015 | Riggs | F16L 23/10 166/84.1 |
| 9,057,239 | B2 * | 6/2015 | Young | E21B 33/038 |
| 9,068,433 | B2 * | 6/2015 | Bushman | E21B 41/0007 |
| 9,856,713 | B2 * | 1/2018 | Tarique | E21B 33/085 |
| 2005/0236836 | A1 | 10/2005 | Williams | |
| 2012/0013133 | A1 * | 1/2012 | Rios, III | E21B 23/01 292/159 |
| 2014/0238686 | A1 * | 8/2014 | Boyd | E21B 17/01 166/367 |
| 2016/0123399 | A1 * | 5/2016 | Arnt | E21B 33/085 384/559 |
| 2016/0258239 | A1 * | 9/2016 | Clark | E21B 33/085 |
| 2016/0305213 | A1 * | 10/2016 | Godfrey | E21B 33/085 |
| 2019/0093445 | A1 * | 3/2019 | Kulkarni | E21B 33/085 |

* cited by examiner

ROTATING CONTROL DEVICE HAVING AN ANTI-ROTATION LOCKING SYSTEM

BACKGROUND

During drilling operations, drilling mud may be pumped into a wellbore. The drilling mud may serve several purposes, including applying a pressure on the formation, which may reduce or prevent formation fluids from entering the wellbore during drilling. The formation fluids mixed with the drilling fluid can reach the surface, resulting in a risk of fire or explosion if hydrocarbons (liquid or gas) are contained in the formation fluid. To control this risk, pressure control devices are installed at the surface of a drilling, such as one or more blowout preventers (BOPs) that can be attached onto a wellhead above the wellbore. A rotating control device (RCD) is typically attached on the top of the BOPs to divert mud/fluid to, and circulate it through, a choke manifold to avoid the influx of fluid reaching a drilling rig floor (as well as allowing pressure management inside the wellbore). A bearing assembly is used for purposes of controlling the pressure of fluid flow to the surface while drilling operations are conducted. The bearing assembly is typically raised by a top drive assembly and then inserted into a "bowl" of the RCD. The bearing assembly rotatably receives and seals a drill pipe during drilling operations through the wellhead. Thus, the bearing assembly acts as a seal and a bearing, as supported by the RCD housing.

After the bearing assembly is inserted into the bowl of the RCD, the RCD can be operated to "lock" a stationary housing of the bearing assembly to the RCD housing (while still allowing for the rotational components of the bearing assembly to rotate along with a rotating drill pipe). This "locking" function is typically performed with ram mechanisms coupled to the RCD housing and that are actuated to lock the bearing assembly to the RCD housing, and then actuated to unlock the bearing assembly from the RCD housing (such as when seals of the bearing assembly need to be replaced). The ram mechanism must have internal machine threads and a threaded rod, and a motor to rotate the threaded rod. The rod drives the ram into the bearing assembly to lock it. This is disadvantageous because the ram mechanism must be locked manually by an operator, which is dangerous and time consuming. Another type of locking mechanisms includes a clamp mechanism that is manually or hydraulically actuated to lock the bearing assembly to the RCD housing, which is also dangerous and time consuming.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
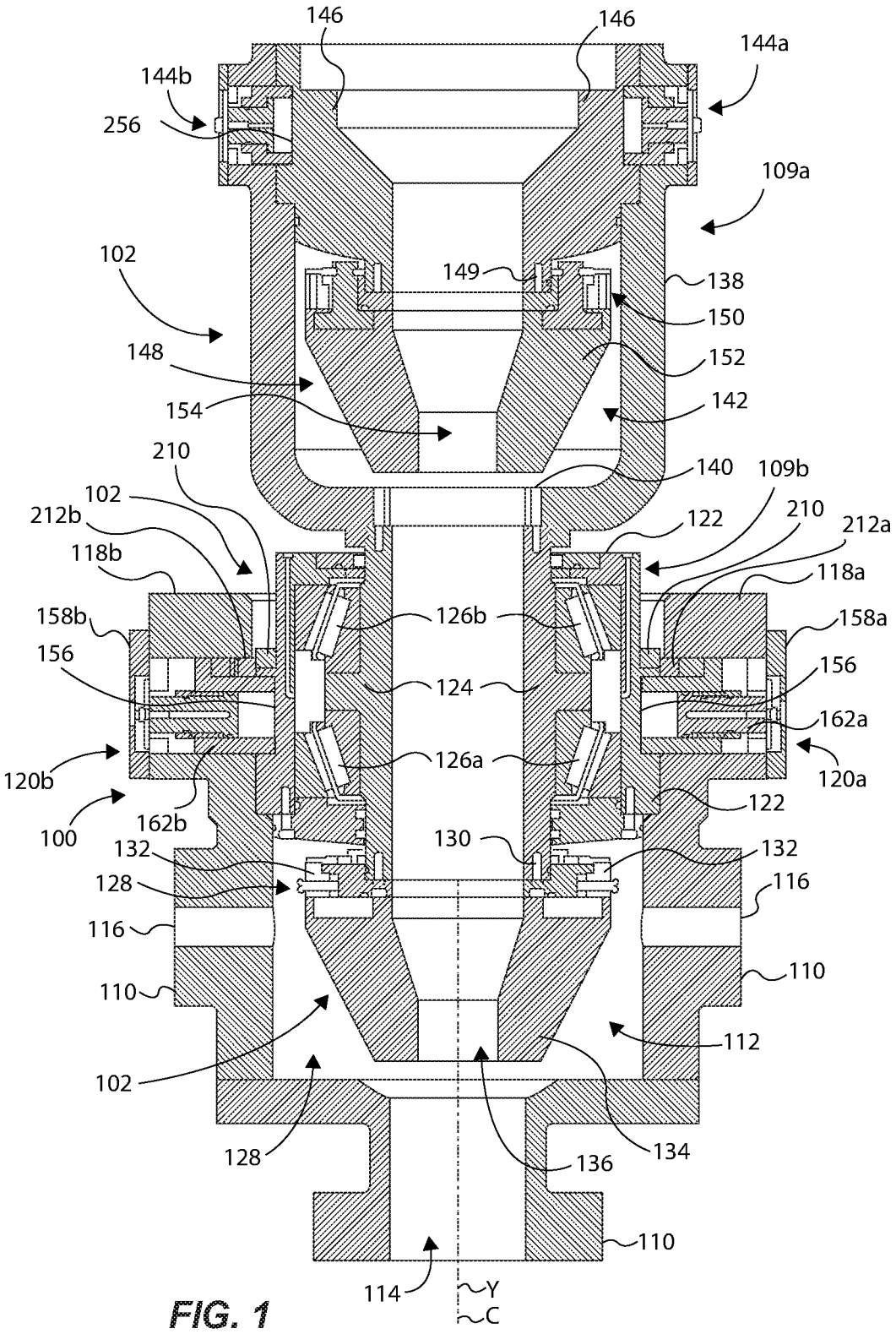
FIG. 1 is a cross-sectional view of an RCD having a bearing assembly and a locking block system in accordance with an example of the present disclosure, and as taken along lines 1-1 in FIG. 2.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The present disclosure sets forth a rotating control device (RCD) having an anti-rotation locking system for restricting rotation of a bearing assembly housing of the RCD. The RCD comprises an RCD housing operable with a blowout preventer, and a bearing assembly operable to be received within the RCD housing and comprising a stationary bearing housing. The bearing assembly can be configured to receive and engage with and seal a pipe of a drill string of a drill rig. The stationary bearing housing can have secured thereto a locking ring. The anti-rotation locking system of the RCD can further comprise one or more anti-rotation devices moveable between a locked position and an unlocked position, the anti-rotation device(s) operable to engage the locking ring, when in the locked position, to lock the stationary bearing housing to the RCD housing independent of the rotational position of the stationary bearing housing relative to the RCD housing.

The present invention also sets forth a method for restricting rotation of a bearing assembly housing of a rotating control device (RCD) of a drilling rig. The method comprises operating an RCD coupled to a blowout preventer of a drill rig. The RCD comprises an RCD housing operable with the blowout preventer, and a bearing assembly receivable into the RCD housing and operable to receive a pipe of a drill string; and a plurality of anti-rotation devices supported by the RCD housing. The method can further comprise inserting the bearing assembly into the RCD housing, the bearing assembly comprising a stationary bearing housing and a locking ring; and operating an anti-rotation locking system to lock the stationary bearing housing to the RCD housing, wherein the anti-rotation devices move from an unlocked position to a locked position and engage the locking ring, thereby restricting rotation of the stationary bearing housing relative to the RCD housing, the anti-rotation devices engaging the locking ring independent of the rotational position of the stationary bearing housing relative to the RCD housing.

The present disclosure still further sets forth a method for operating a rotating control device (RCD) of a drill rig, the method comprising operating an RCD coupled to a blowout preventer of a drill rig, the RCD comprising an RCD housing operable with the blowout preventer, and a bearing assembly receivable into the RCD housing and operable to receive a pipe of a drill string; a plurality of locking block assemblies supported by the RCD housing, each locking block assembly having a moveable block; and a plurality of anti-rotation devices supported by the locking block assemblies. The method can further comprise applying an actuation force to the moveable blocks to move the moveable blocks to an unlocked position; selectively maintaining the moveable blocks in the unlocked position by maintaining application of the actuation force on the moveable blocks; inserting the bearing assembly into the RCD housing, the bearing assembly comprising a stationary bearing housing and a locking ring secured to the stationary bearing housing; and removing the actuation force to cause the moveable blocks to transition from the unlocked position to a locked position, such that the anti-rotation devices interface with and engage the locking ring to lock the stationary bearing housing to the RCD housing.

To further describe the present technology, examples are now provided with reference to the figures.

Figure 2:
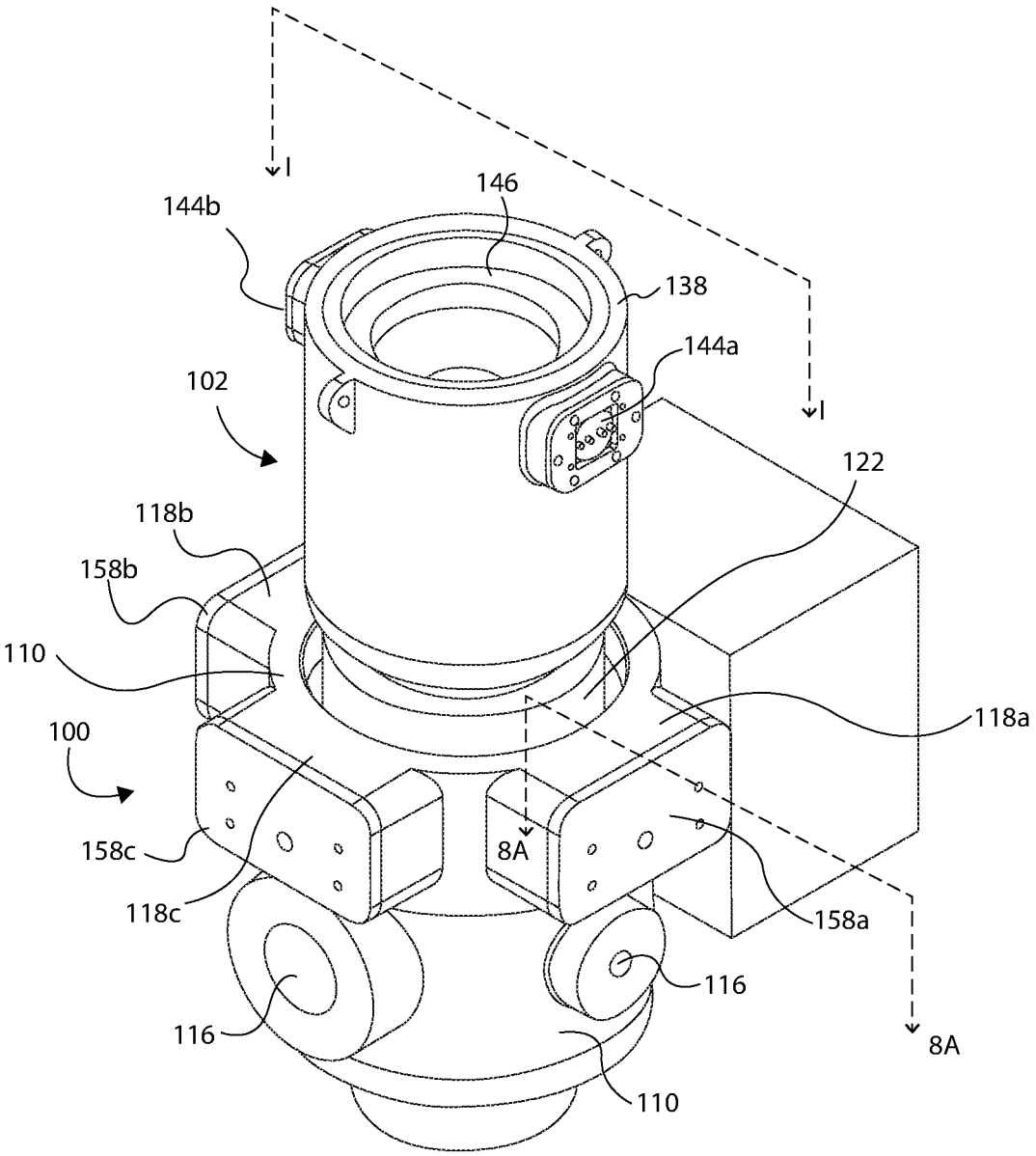
FIG. 2 is an isometric view of the RCD of FIG. 1.
Figure 3:
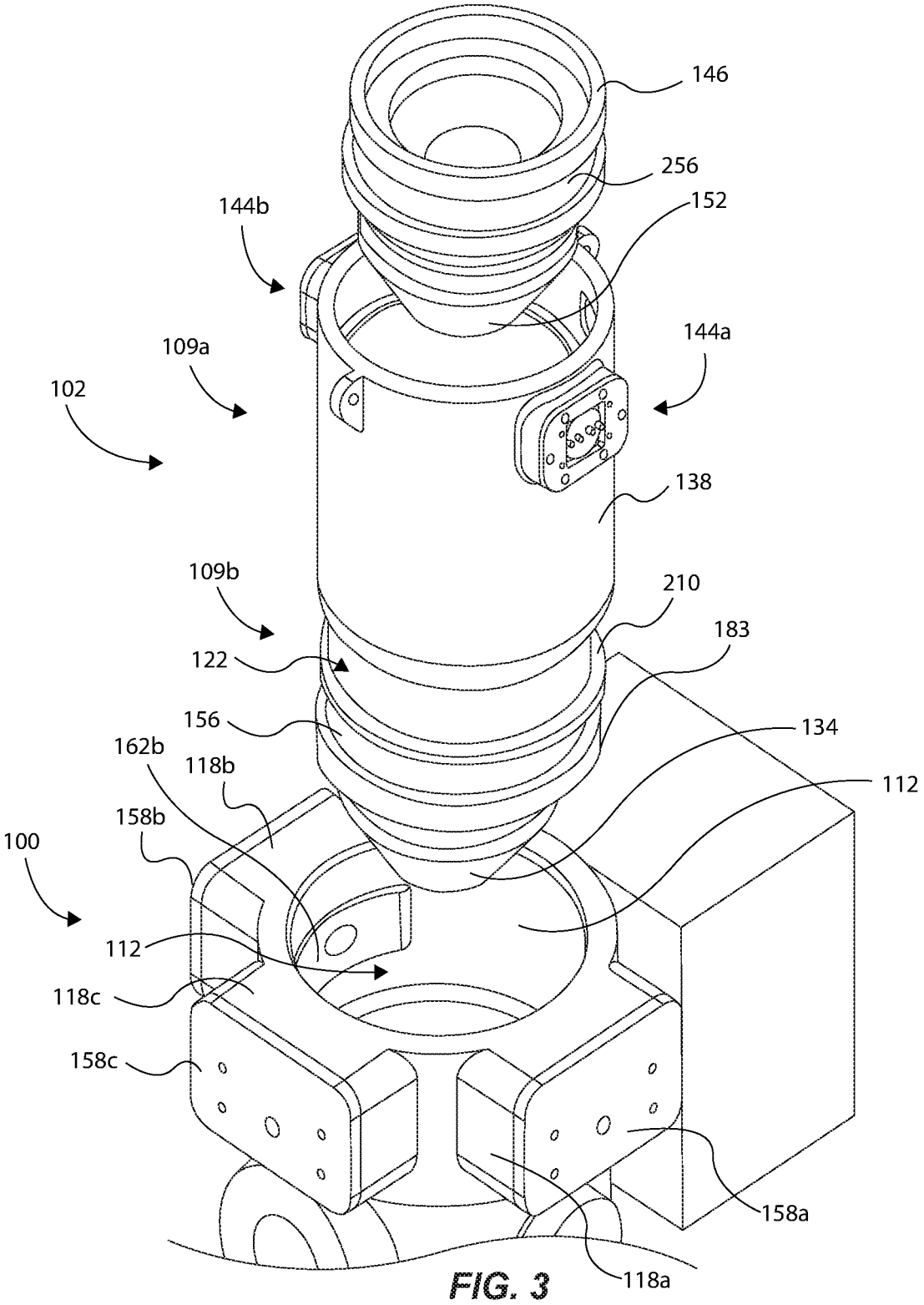
FIG. 3 is an exploded isometric view of the RCD of FIG. 1.
Figure 4:
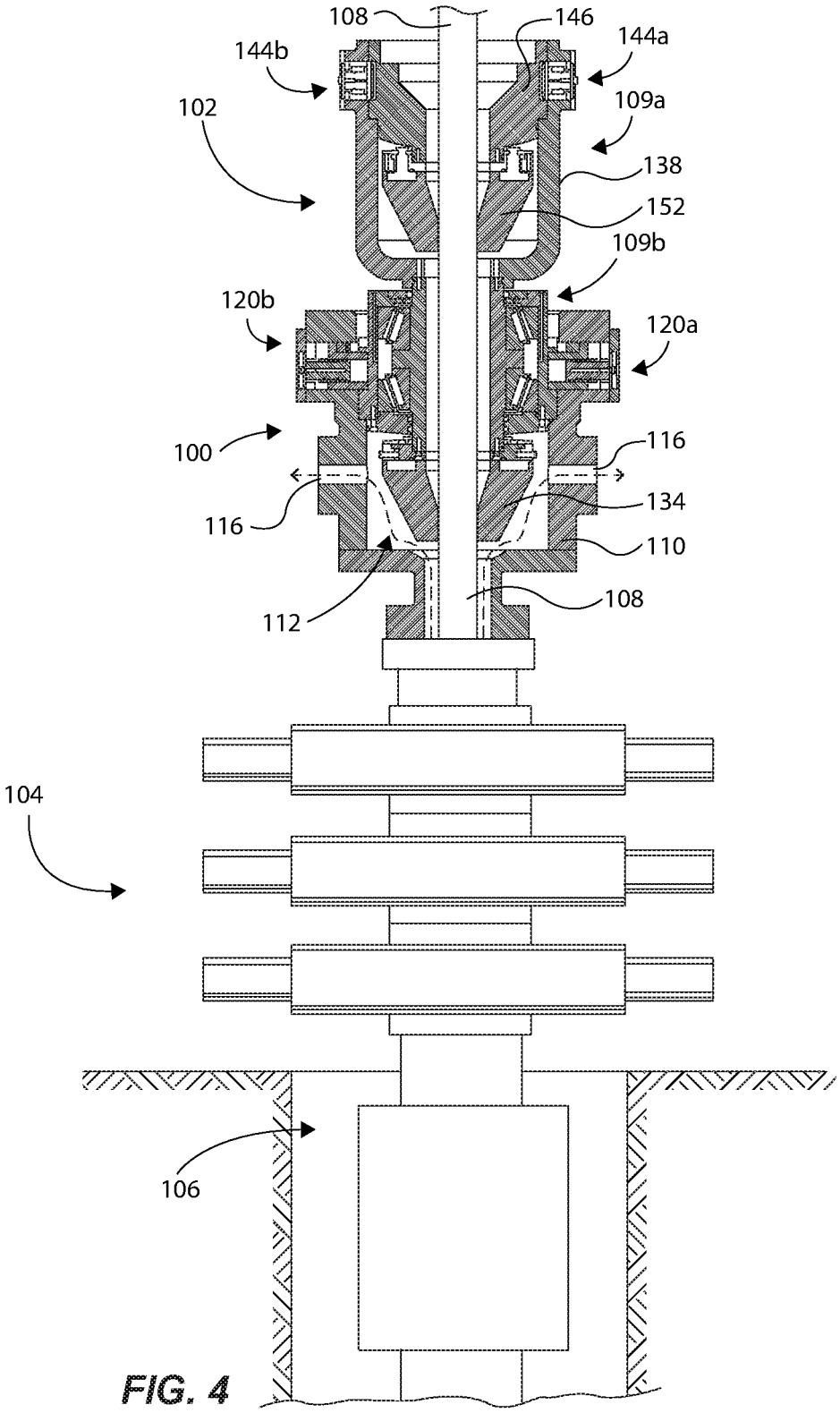
FIG. 4 is a cross-sectional view of the RCD of FIG. 1, taken along lines 1-1 in FIG. 2, with the RCD shown as being coupled to BOPs about a wellbore.

FIGS. 1-4 are illustrated as follows: FIG. 1 shows a cross-sectional view of a rotating control device (RCD) 100 having a bearing assembly 102; FIG. 2 shows an isometric view of the RCD 100 and its bearing assembly 102; FIG. 3 shows a partially exploded view of the RCD 100 and its bearing assembly 102; and FIG. 4 shows a cross-sectional view of the RCD 100 (and its bearing assembly 102) coupled to BOPs 104 above a wellbore 106. As illustrated in FIG. 4, the RCD 100 is attached on the top of and operable with the stack of BOPs 104 to divert mud/fluid away from a rig floor. The bearing assembly 102 can be used for purposes of controlling the pressure of fluid flow to the surface while drilling operations are conducted. The bearing assembly 102 can be operable with and raised by a top drive assembly (not shown) (or other means) and then inserted into an RCD housing 110 of the RCD 100 in a manner, such that the bearing assembly 102 receives and seals a drill pipe 108 during drilling operations. Thus, the bearing assembly 102 acts as a seal and a bearing, as supported by the RCD housing 110, during drilling operations.

With reference to FIGS. 1-4, the bearing assembly 102 of the RCD 100 comprises an upper sealing assembly 109*a* and a lower bearing assembly 109*b* coupled or otherwise secured to each other. The RCD housing 110 is configured to be coupled to the top of the BOPs 104 (see FIG. 4). The housing 110 comprises a bowl area 112 sized to receive the lower bearing assembly 109*b* of the bearing assembly 102. The housing 110 comprises a lower opening 114 through which the drill pipe 108 (FIG. 4) loosely passes through to the BOPs 104. The housing 110 further comprises a plurality of openings 116 through which mud/fluid can be diverted to other systems during drilling operations.

Figure 7A:
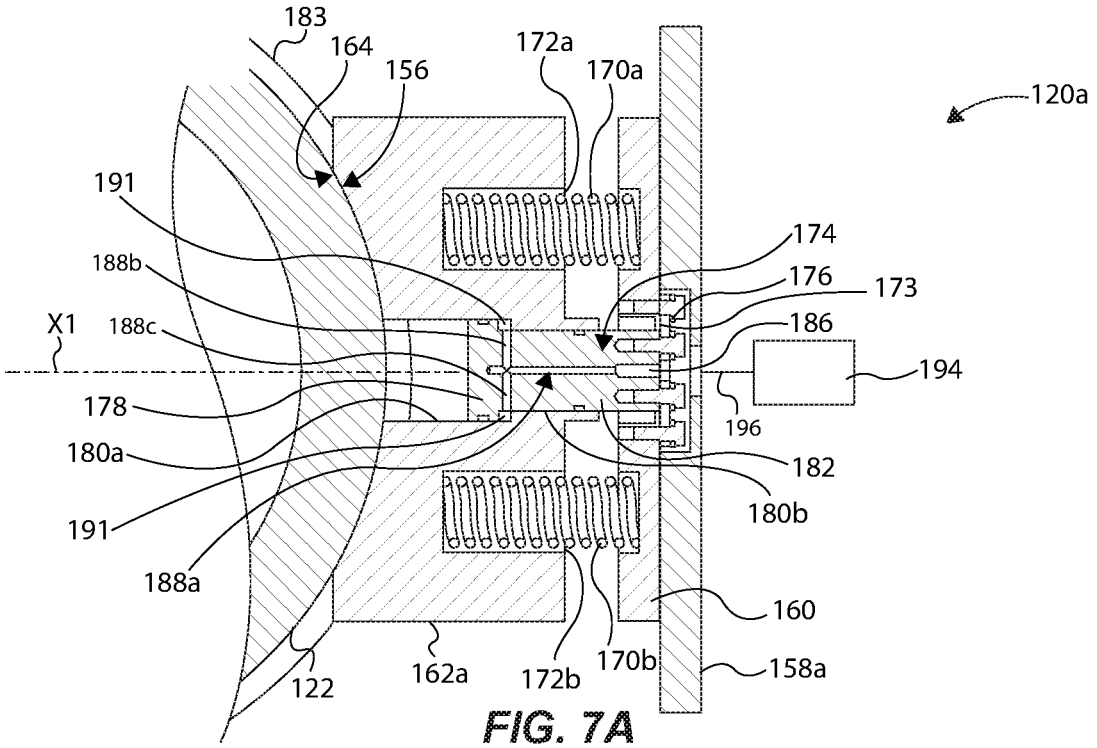
FIG. 7A is a partial cross-sectional view of the bearing assembly of FIG. 1 taken along lines 7A-7A of FIG. 5, illustrating the locking block assembly in a locked position.
Figure 7B:
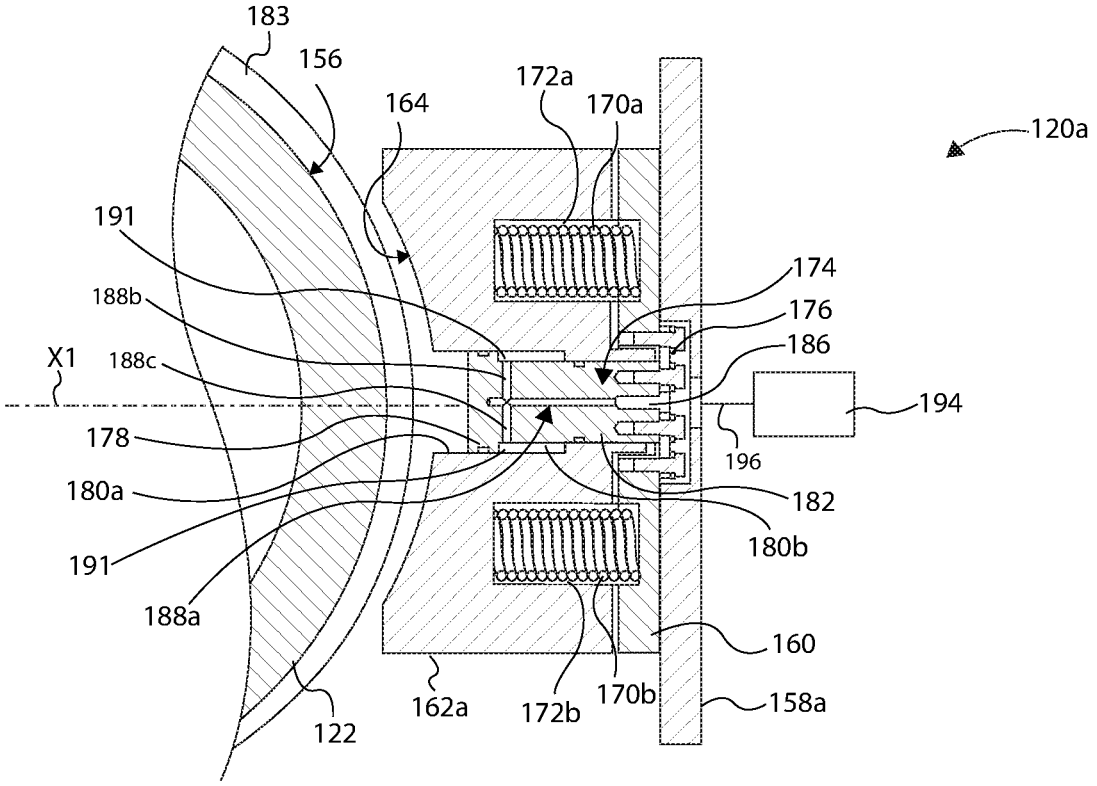
FIG. 7B is a partial cross-sectional view of the bearing assembly of FIG. 1, taken along lines 7A-7A of FIG. 5, illustrating the locking block assembly in an unlocked position.

The housing 110 can comprise sub-housings 118*a-c* that each support respective lower locking block assemblies as part of a locking block system for the RCD 100 (see lower locking block assemblies 120*a*, 120*b* in FIG. 1, with the sub housing 118*a-c* also comprising a similar lower locking block assembly, even though not specifically shown) that are each coupled to and supported by the housing 110. The three locking block assemblies shown are arranged annularly relative to one another, and provide three points of contact on the bearing assembly 102. However, in another example, only two locking block assemblies may be incorporated. As will be detailed below, the locking block system, and particularly each locking block assembly 120*a-c*, is operable between a locked position (e.g., FIG. 7A) that locks the bearing assembly 102 to the housing 110, and an unlocked position (e.g., FIG. 7B) that unlocks the bearing assembly 102 from the housing 110. One primary purpose of unlocking (and removing) the bearing assembly 102 from the housing 110 is to replace sealing elements of the bearing assembly 102 between downhole drilling operations, as detailed below.

The bearing assembly 102 can comprise a stationary bearing housing 122 that rotatably supports a lower sealing element sleeve 124 via upper and lower bearing assemblies 126*a* and 126*b* (FIG. 1). The upper and lower bearing assemblies 126*a* and 126*b* can be situated between the lower sealing element sleeve 124 and the stationary bearing housing 122 to rotatably support the lower sealing element sleeve 124 about the stationary bearing housing 122. In one example, as shown, the bearing assemblies 126*a* and 126*b* can comprise tapered bearings (tapered bearings are well known and will not be discussed in great detail). It is noted that those skilled in the art will recognize that other types of bearing assemblies could be used, and incorporated between the stationary bearing housing 122 and the lower sealing element sleeve 124. As such, the tapered bearings shown are not intended to be limiting in any way.

A lower sealing assembly 128 can be attached to a lower end of the rotary casing 124 via fasteners 130. The lower sealing assembly 128 can comprise a lower plate lock device 132 and a lower sealing element 134 (e.g., rubber stripper/packer) removably coupled to the lower plate lock device 132. One example configuration of the lower sealing assembly 128 is further described in U.S. patent application Ser. No. 16/054,969, filed Aug. 3, 2018, which is incorporated by reference herein in its entirety. Those skilled in the art will recognize other ways for coupling the lower sealing element 134 to or about the bearing assembly 102.

The lower sealing element 134 can comprise an opening 136 sized to receive a pipe 108 (FIG. 4), wherein the lower sealing element 134 interfaces with and seals against the pipe 108 to function as a seal as the pipe 108 rotates with the lower sealing element 134, which seal prevents mud/debris from entering the bearing assembly 102 and facilitates routing of the mud/debris out the side openings 116. Thus, as the pipe 108 rotates during drilling operations, the lower sealing element 134 concurrently rotates, thereby rotating the lower sealing element sleeve 124 (as rotatably supported by the tapered bearing assemblies 126*a* and 126*b*).

In one example, as shown, the upper sealing assembly 109*a* can comprise a rotary bearing housing 138 coupled to an upper end of the lower sealing element sleeve 124 via fasteners 140. Note that the upper sealing assembly 109*a* is an optional assembly that can be coupled to the lower bearing assembly 109*b*; however, only the lower bearing assembly 109*b* may be utilized in some applications as desired. The rotary bearing housing 138 defines a bowl area 142, and supports a plurality of upper locking block assemblies 144*a* and 144*b* operable to lock and unlock an upper rotary casing 146, via a perimeter channel 256 of the upper rotary casing 146, from the rotary bearing housing 138, as further detailed below. An upper sealing assembly 148 can be coupled to a lower end of the upper rotary casing 146 via fasteners 149. The upper sealing assembly 148 can comprise an upper plate lock device 150 and an upper sealing element 152 (e.g., a rubber stripper/packer) removably coupled to the upper plate lock device 150. The configuration of the upper sealing assembly 148 is further described in U.S. patent application Ser. No. 16/054,969, filed Aug. 3, 2018, which is incorporated by reference herein in its entirety. The upper sealing element 152 can comprise an opening 154 sized and configured to receive the pipe 108, wherein the upper sealing element 152 tightly grips and seals against the pipe 108 (FIGS. 1 and 3) to act as a seal as the pipe 108 rotates along with the upper sealing element 152. Thus, as the pipe 108 rotates during drilling operations, and as the lower sealing element 134 and the lower sealing element sleeve 124 rotate, the entire upper sealing assembly 109*a* rotates (including the rotary bearing housing 146 and the upper sealing element 152). Thus, the bearing assemblies 126*a* and 126*b* also rotatably support the upper sealing assembly 109*a* via the lower sealing element sleeve 124. As can be appreciated, only the upper and lower sealing elements 152 and 134 are in contact with portions of the pipe 108 as it extends through the respective openings 136 and 154, and as the pipe 108 rotates during drilling.

When the upper and lower sealing elements 152 and 134 wear down and need to be replaced (e.g., sometimes daily), the bearing assembly 102 can be removed from the RCD housing 110 when the lower locking block assemblies (e.g., lower locking block assemblies 120*a-c*) are in the unlocked position (discussed below). Once the bearing assembly 102 is removed, the lower sealing element 134 can be removed (via the lower plate lock device 128) and replaced with a new sealing element. Similarly, the upper rotary casing 146 (and the attached upper sealing element 152) can be removed from the rotary bearing housing 138 upon moving the upper locking block assemblies 144*a* and 144*b* to the unlocked position, and the upper sealing element 152 replaced with a new sealing element.

With reference to FIGS. 5-7B, and continued reference to FIGS. 1-4, the configuration and operation of the lower locking block assemblies 120*a-c* (and the upper locking block assemblies 144*a* and 144*b*) is discussed below in further detail. Each lower locking block assembly 120*a-c* is operable between the locked position (FIGS. 1, 5, and 7A) that locks the bearing assembly 102 to the housing 110, and an unlocked position (FIG. 7B) that unlocks the bearing assembly 102 from the housing 110 so that it can be removed for any given purpose.

Figure 5:
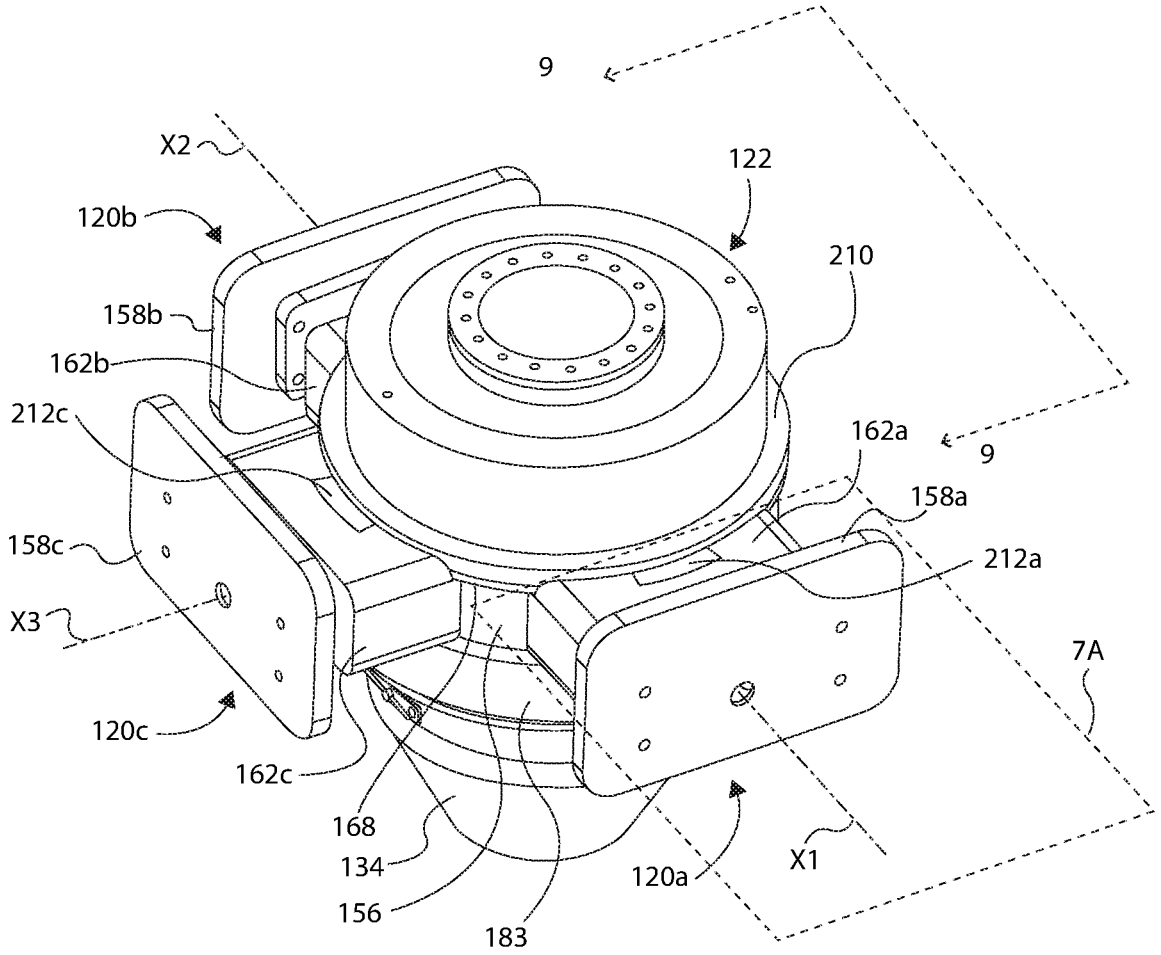
FIG. 5 is an isometric view of a portion of the locking block system of the RCD and a portion of the bearing assembly of FIG. 1, FIG. 5 further illustrating an anti-rotation locking system in accordance with one example.

More specifically, and in one example, the stationary bearing housing 122 can comprises a perimeter or circumferential groove or channel 156 formed as an annular recess around the generally cylindrically-shaped stationary bearing housing 122 (see e.g., FIGS. 1, 3 and 5). The perimeter channel 156 can be defined, at least in part, by an upper annular flange member 168, and a shoulder portion 183, each extending outwardly from the perimeter channel 156. Note that FIG. 5 only shows the lower bearing assembly 109*b* and the lower locking block assemblies 120*a-c* (the upper sealing assembly 109*a* and the housing 110 are omitted for illustration clarity, to show the lower locking block assemblies 120*a-c* locked to the stationary bearing housing 122).

Figure 6:
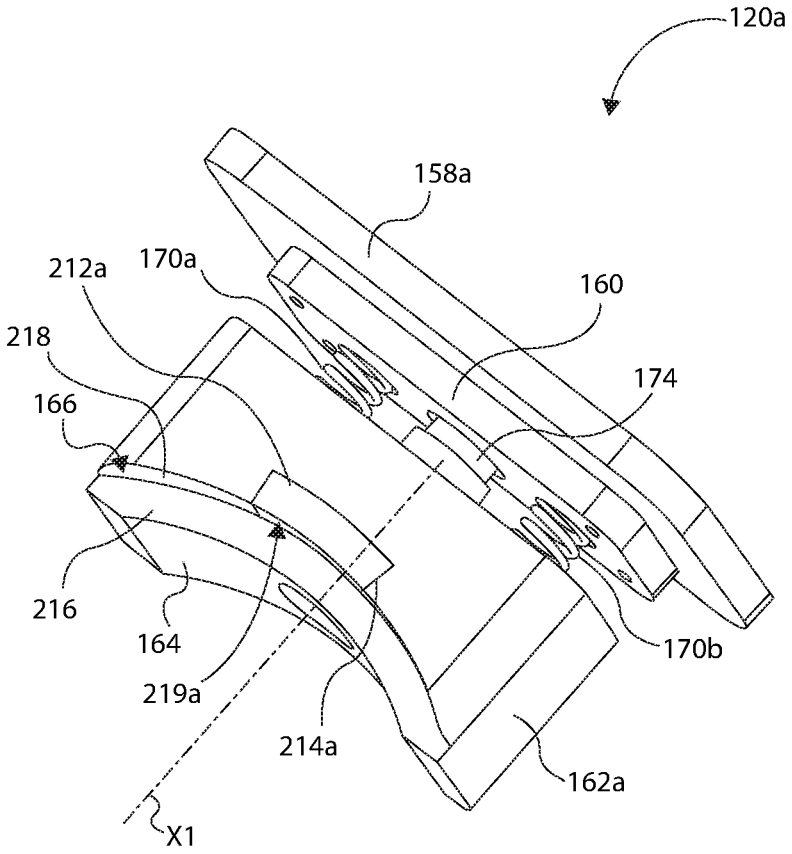
FIG. 6 is an isometric view of a movable block of a locking block assembly of the locking block system of the RCD of FIG. 1.

The lower locking block assemblies 120*a-c* can each comprise a housing support member 158*a-c* removably coupled to respective sub-housings 118*a-c* via fasteners (not shown), for instance (see e.g., FIGS. 1, 5, and 6). The housing support members 158*a-c* are each removable to allow access to the inside of the sub-housings 118*a-c* and the internal mechanisms of the locking block assemblies 120*a-c* for installation and maintenance of the locking block assemblies 120*a-c*.

With continued reference to FIGS. 1-5, and further reference to FIG. 6 (showing one lower locking block assembly 120*a* as an example, with the other locking block assemblies comprising similar configurations and interfaces), the locking block assembly 120*a* comprises a moveable block 162*a* configured to interface with the perimeter channel 156 of the stationary bearing housing 122 (see also FIG. 5), as well as an upper annular flange 168 and the shoulder portion 183 of the bearing housing 122. Specifically, the moveable block 162*a* comprises a channel interface surface 164 having a radial configuration that corresponds to a radial surface of the perimeter channel 156 when in the locked position (see FIG. 5 and discussion below pertaining to FIG. 7A). The moveable block 162*a* can further comprise a shoulder portion 166 that interfaces with and engages the upper annular flange member 168 of the stationary bearing housing 122 (further detailed below), wherein a lower portion of the moveable block 162*a* is about the shoulder portion 183. This same arrangement and relationship is provided for with respect to each of the other locking block assemblies 120*a-c*. Thus, when in the locked position, the upper annular flange member 168 is seated about or within each of the shoulder portions (e.g., 166) of each of the respective lower locking block assemblies 120*a-c*, that interface with the stationary bearing housing 122 when in the locked position and during drilling operations. When in the unlocked position, the upper annular flange member 168 becomes unseated from the shoulder portions of the respective lower locking block assemblies 120*a-c*.

The term "block" can mean generally a block or cuboid shaped component, such as one having a rectangular cross-sectional area (along one or more planes). However, this is not intended to be limiting in any way to the shape or configuration of the moveable component that can interface and engage with the stationary bearing housing 122. Thus, shapes other than "blocks" could be formed and achieve the same function and result, such as a spherically shaped moveable component that interfaces with a corresponding spherical surface of the stationary bearing housing 122, for instance.

In one example, the locking block assembly 120*a* can comprise a pair of elastic components 170*a* and 170*b* configured to automatically bias (i.e., apply a force, such as a spring force, to and in the direction of) the moveable block 162*a* in the locked position. More specifically, and with further reference to FIGS. 7A and 7B, each elastic component 170*a* and 170*b* can comprise a spring, such as a coil or other type of spring, seated at one end against a back plate 160, and seated at the other end in respective openings 172*a* and 172*b* formed through the moveable block 162*a*. The back plate 160 can be interfaced and coupled to the housing support member 158*a* via a coupling device 173 fastened to both of the back plate 160 and to the housing support member 158*a*. In the locked position of FIG. 7A, the elastic components 170*a* and 170*b* are in an expanded state that automatically exerts a biasing spring force against the moveable block 162*a* away from the housing support member 158*a* and inwardly toward the perimeter channel 156, therefore seating the moveable block 162*a* into the perimeter channel 156 between the annular flange portion 168 and the shoulder portion 183 of the bearing housing 122 to lock the bearing assembly 102 to the housing 110 (see also FIGS. 1 and 5). Thus, the elastic components 170*a* and 170*b* can be installed in a pre-loaded state, such that they are configured to exert a force on or push the moveable block 162*a* in a direction so as to place the bearing assembly 102 in the locked position. Those skilled in the art will recognize that the elastic components can be any elastic component or element that acts in a spring-like manner, namely one that can be pre-loaded and caused to apply or exert a biasing force on the moveable block 162*a*. Example elastic components can include, but are not limited to, an elastic polymer, a compressed gas component, or a variety of other spring-like elements. In some examples, only one elastic component may be incorporated to perform the function of biasing the moveable block 162*a* in the locked position. Again, although not discussed in detail, the same arrangement and interface with the bearing assembly can be provided for with respect to each of the other locking block assemblies.

Regarding transitioning or moving from the locked position (FIG. 7A) to the unlocked position (FIG. 7B), in one example the lower locking block assembly 120*a* can comprise an actuator device 174 coupled to the coupling device 173 (and the back plate 160) via fasteners 176 (one labeled). The actuator device 174 can be a cylindrical one-way or single acting actuator device, and can comprise a hydraulic or pneumatic type of actuator device. In the specific example shown, which is not intended to be limiting in any way, the actuator device 174 can comprise a head 178 that is received through a first opening 180*a* of the moveable block 162*a*. The actuator device 174 can further comprise a body section 182 extending from the head portion 178. The body section 182 can be received through a second opening 180*b* of the moveable block 162*a*. The second opening 180*b* can be sized slightly smaller in diameter than the first opening 180*a* so that the actuator device 174 is slidably received through the first and second openings 180*a* and 180*b*, as shown when comparing FIGS. 7A and 7B.

The body section 182 of the actuator device 174 can comprise a fluid port 186 and a first fluid conduit 188*a* in fluid communication with each other. The first fluid conduit 188*a* can be a linear fluid opening in fluid communication with second and third conduits 188*b* and 188*c* that each extends orthogonal from the first fluid conduit 188*a*, as formed through the head portion 178. The second and third conduits 188*b* and 188*c* are in fluid communication with a fluid pressure chamber 191 defined by the first opening 180*a* and the actuator device 174. Thus, the head portion 178 is positioned slightly laterally offset from an end of the first opening 180*a* (FIG. 7A) to accommodate fluid communication between the transverse conduits 188*b* and 188*c* and the fluid pressure chamber 191 adjacent an inside surface of the head portion 178 (and when in the locked position). This allows for the fluid pressure chamber 191 to be filled with a fluid (liquid or gas) via the conduits 188*a-c* of the actuator device 174.

Accordingly, a fluid (hydraulic or pneumatic) system 194 (schematically shown) can be operatively coupled to the lower locking block assembly 120*a*, wherein the hydraulic system 194 can comprise a fluid line 196 in fluid communication with the fluid port 186. Thus, when the lower locking block assembly 120*a* is in the locked position of FIG. 7A, the fluid system 194 is operable to actuate the moveable block 162*a* to the unlocked position of FIG. 7B, upon supplying fluid pressure to the fluid pressure chamber 191 via the fluid port 186. That is, when fluid pressure is supplied to the fluid port 186, fluid traverses through the first conduit 188*a*, and then through the second and third conduits 188*b* and 188*c*, and ultimately to the fluid pressure chamber 191. The volume of the fluid pressure chamber 191 increases as fluid pressure is supplied thereto, which causes the moveable block 162*a* to be drawn (to the right) toward the back plate 160 (FIG. 7B), thereby causing compression of the elastic components 170*a* and 170*b*. In this manner, the fluid system 194 is operable to selectively maintain the moveable blocks 162*a-c* in the unlocked position by maintaining application of an actuation force (e.g., the supply of fluid pressure) to the moveable blocks 162*a-c* to be in the unlocked position. This allows for insertion of the bearing assembly 102 into the housing 110 (or removal therefrom) by a top drive assembly, for instance, because the stationary bearing housing 122 is uncoupled and free from being locked or fixed to the RCD housing 110 by the lower locking block assemblies 120*a-c*.

As can be appreciated, such actuation force applied by the fluid system 194 to move the moveable block 162*a*, for instance, to the unlocked position is greater than the spring force exerted by the elastic components 170*a* and 170*b* (that maintains the moveable block 162*a* in the locked position). Due to this actuation force, the moveable block 162*a* may effectively move to the unlocked position of FIG. 7B upon supplying sufficient fluid pressure to overcome the spring force being applied by the elastic components 170*a* and 170*b*. The fluid system 194 can comprise a number of hydraulic or pneumatic valves, pumps, motors, controllers, etc., known in the art to supply and remove fluid pressure to a one-way valve, and can be operated manually or automatically by a computer system operable to control the fluid system 194 by known means of controlling fluid pumps and motors.

In this system, the moveable block 162*a* can automatically transition from the unlocked position (FIG. 7B) to the locked position (FIG. 7A), by removing the aforementioned fluid pressure, by virtue of the biasing force of the elastic components 170*a* and 170*b*. This means that the potential energy that is stored by the elastic components 170*a* and 170*b* can be released (when transitioning from the unlocked to locked position), upon removing fluid pressure (i.e., removing the actuation force) via the fluid system 194. This allows the elastic components 170*a* and 170*b* to expand, thereby automatically moving the moveable block 162*a* to the locked position of FIG. 7A. Thus, there is no active actuation or external control of the moveable block 162*a* to cause it to move to the locked position. Indeed, it is the stored spring force that passively, and automatically, actuates the moveable block 162*a* to the locked position.

Advantageously, this system provides a fail-safe device to help prevent injury to operators working around the bearing assembly 102 and the RCD housing 110 because the locking block assemblies 120*a-c* are caused to be in a locked position by default, and to automatically self-lock to the bearing assembly 102 upon removing fluid pressure from the moveable blocks 120*a-c*. For example, if fluid pressure is lost due to failure of the hydraulic system for some reason, the locking block assemblies 120*a-c* will automatically move to the locked position via the aforementioned stored spring force. This can ensure that the bearing assembly 102 is not blown out upwardly by wellbore fluid pressure during drilling in instances where the system fails or loses pressure, which can potentially be catastrophic to the system and human operators. Moreover, there is no requirement for a human operator to manually interact with or engage the bearing assembly 102 to lock it to the RCD housing 110, which improves safety and efficiency of the system because it prevents possible injury while automating the locking function, in contrast with prior systems that are manually operated (e.g., with rams, clamps, etc.), and/or that require the system to perform an active actuation function to lock the bearing assembly.

Such "automatic" locking movement to the locked position also assists to properly align the bearing assembly 102 with the RCD housing, which is important for proper downhole drilling and to prolong the life of the bearing assembly 102. This is because, with prior current or existing technologies that rely on active actuation to lock a bearing assembly to an RCD housing (e.g., ram locks controlled by electric or hydraulic motors or actuators), precisely controlling the travel and position of such ram locks relative to each other is difficult and problematic because, in many instances, one of the ram locks may move too quickly (and/or its starting position may be unknown), thereby contacting the bearing assembly before the other ram locks happen to contact the bearing assembly. This often misaligns the bearing assembly relative to the RCD housing (i.e., the central axis of the wellhead and RCD housing may be not-collinear with the rotational axis of the bearing assembly). This can cause the bearing assembly to rotate off-axis relative to the central axis of the RCD housing, which can cause the bearings and sealing elements to wear down more rapidly. This can also damage components of the overall system in instances where the ram locks are in different lateral positions around the bearing assembly, or even cause mud/debris to enter into and through the bearing assembly.

However, with the present technology disclosed herein, the (expanding) the locking block assemblies 120*a-c*, including the respective moveable blocks 162*a-c* and the elastic components (e.g., 170*a* and 170*b*) associated with each moveable block 162*a-c*, when transitioning to the locked position, are configured to and tend to compensate for possible misalignment. For example, if the moveable block 162*a* first contacts the stationary bearing assembly 122 before the other moveable blocks 162*b* and 162*c* happen to contact the stationary bearing assembly 122, the elastic components 170*a* and 170*b* of the moveable block 162*a* may slightly compress to accommodate for the pressure applied by the other moveable blocks 162*b* and/or 162*c* when they (eventually) contact the stationary bearing housing 122. Thus, the bearing assembly 102 tends to float about the housing 110 when the moveable blocks 162*a-c* transition from the unlocked position to the locked position, so that the bearing assembly 102 is allowed to self-align with the RCD housing 110 in lateral directions. The strategic positioning of the locking block assemblies 120*a-c* relative to one another can also assist in helping the system to self-align (e.g., the locking block assemblies being spaced a strategic distance from one another). In this manner, the elastic component(s) of each of the moveable blocks 162*a-c* may be identical or substantially the same (e.g., have the same spring constant, material, pre-load position, length, and other properties). Therefore, an equal or substantially equal amount of biasing spring force may be exerted by each of the lower locking block assemblies 120*a-c*. This can help to ensure that there is an equal amount of force being exerted against and around the bearing assembly 102 to maintain it in the locked position. However, some differences in the amounts of applied force from each of the locking block assemblies 120*a-c* can be possible and accounted for, such as may be the case if the bearing assembly 102 is not precisely aligned with the RCD housing 110.

This "floating" functionality can also be advantageous during drilling operations and while components of the bearing assembly 102 rotate. For example, if the bearing assembly 102 happens to slightly move laterally relative to the housing 110 and pipe 108 along the x axis and/or y axis, the elastic components of one or more locking block assemblies can slightly compress (or expand as the case may be) due to said slight lateral movement of the bearing assembly 102. This assists to continuously align the bearing assembly 102, in real-time during drilling, relative to the housing 110 to facilitate lateral movement of the bearing assembly 102 in at least one translational degree of freedom (x and/or y translational axes). Therefore, the bearing assembly 102 can be maintained in a constant aligned position relative to the housing 110. This can further prolong the life of components of the system, such as the upper and lower sealing elements 152 and 134, and the tapered bearings 126*a* and 126*b*, because an axis of rotation Y of the bearing assembly 102 can be substantially or completely aligned with a vertical centerline C of the RCD housing 110.

As can be appreciated by the view of FIG. 5, each moveable block 162*a-c* has a respective axis of translation X1, X2, and X3 when moved between the locked and unlocked positions. Thus, axis of translation X1 is generally orthogonal to axis of translation X3, which is generally orthogonal to axis of translation X2. Accordingly, axes of translation X1 and X2 are generally collinear with each other. In this manner, the three locking block assemblies 120*a-c* can be positioned to surround the stationary bearing housing 122 at respective 90 degree positions around 270 degrees of the circumference of the stationary bearing housing 122, as shown on FIG. 5, for instance. This particular configuration and assembly is not intended to be limiting in any way as those skilled in the art will recognize that, in one aspect, only two opposing locking block assemblies can be included, or in another aspect, that four or more locking block assemblies can be included, which are positioned annularly around the bearing assembly 102.

Figure 8A:
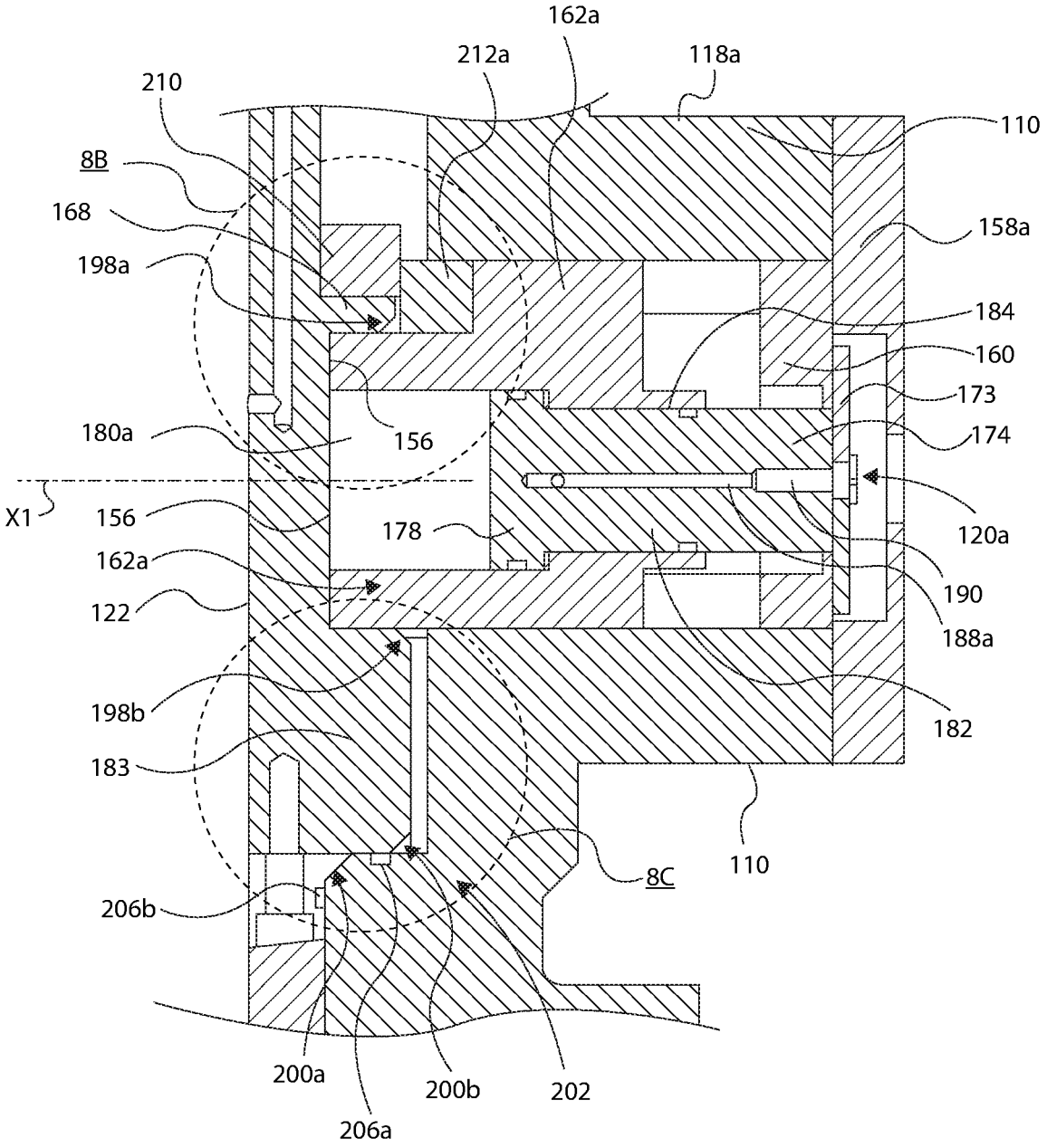
FIG. 8A is a partial cross-sectional view of the RCD housing and bearing assembly of FIG. 1, taken along lines 8A of FIG. 2, and showing the locking block assembly in a nominally locked position with the bearing assembly.
Figure 8B:
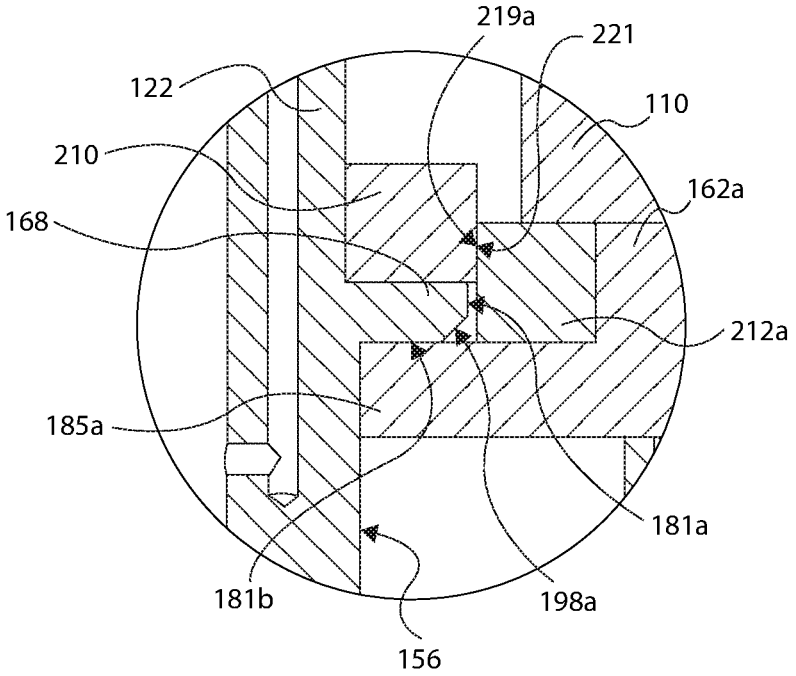
FIG. 8B is a close-up or detailed view of the portion of the bearing assembly identified as 8B in FIG. 8A.
Figure 8C:
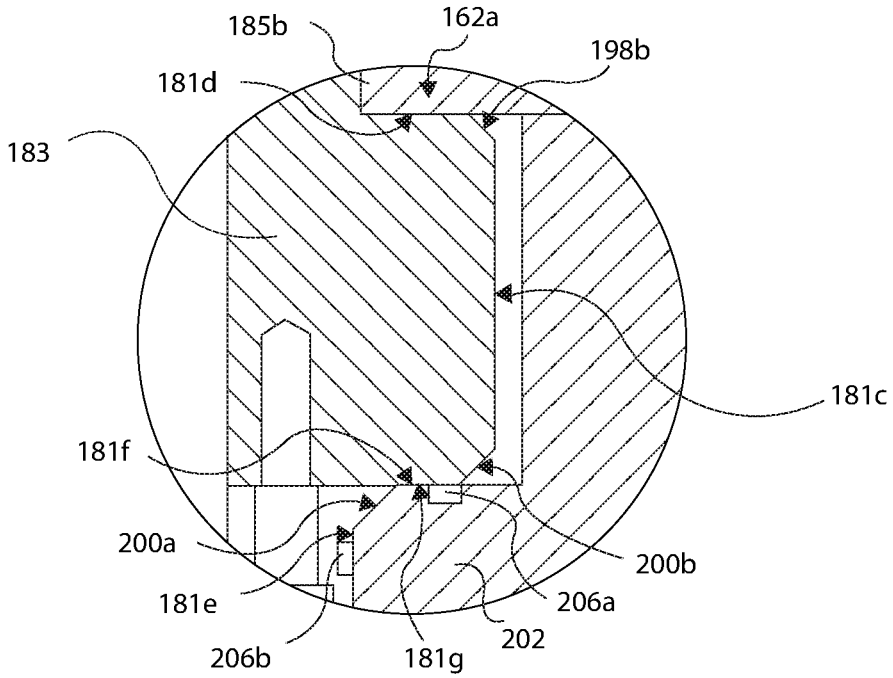
FIG. 8C is a close-up of detailed view of the portion of the bearing assembly identified as 8C in FIG. 8A.

With further reference to FIGS. 8A-8C, the locking block assemblies 120*a-c* can be configured to collectively self-align the bearing assembly 102 to the housing 110 when transitioning from the unlocked position to the locked position. This can be accomplished by forming upper and lower transition surfaces (e.g., upper and lower chamfers 198*a* and 198*b*) radially around the stationary bearing housing 122 adjacent the perimeter channel 156. Specifically, the annular flange member 168 (of the stationary bearing housing 122) comprises an outer radial perimeter surface 181*a* formed vertically about a plane orthogonal to a lower interface surface 181*b* of the annular flange member 168. The transition surface, in this example upper chamfer 198*a*, extends between the radial perimeter surface 181*a* and the interface surface 181*b*, and all the way around the perimeter of the annular flange member 168. Similarly, the stationary bearing housing 122 comprises a shoulder portion 183 extending outwardly from the perimeter channel 156, which shoulder portion 183 comprises a radial perimeter surface 181*c* formed vertically about a plane orthogonal to opposing surfaces 181*d* and 181*g*. A transition surface can also be formed between these surfaces. In the example shown, a lower chamfer 198*b* extends between the lower radial perimeter surface 181*c* and the lower surface 181*d*, and all the way around the perimeter of the annular shoulder portion 183. Therefore, when the moveable block 162*a* is moved from the unlocked position (FIG. 7B) to the locked position (FIGS. 8A-8C), the upper and lower chamfers 198*a* and 198*b* assist to axially or vertically self-align the stationary bearing housing 122. This is because upper and lower corner areas 185*a* and/or 185*b* of the moveable block 162*a* may slide along respective upper and lower chamfers 198*a* and/or 198*b*, which may cause the bearing assembly 102 to move vertically upwardly or downwardly (as the case may be), until each moveable block 162*a-c* is properly, vertically aligned with the perimeter channel 156 of the stationary bearing housing 122 so that the moveable blocks 162*a-c* may properly/fully interface with the perimeter channel 156. Without such upper and lower chamfers 198*a* and 198*b*, the moveable blocks 162*a-c* may jam or bind-up against the stationary bearing housing 122, thereby not properly seating into the perimeter channel 156.

Similarly, the housing 110 itself can also comprise a transition surface, such as a leading chamfer (e.g., chamber 200*a*) formed annularly adjacent a shoulder portion 202 of the housing 110, as shown in FIGS. 8A and 8C. In this example, the shoulder portion 202 comprises a radial perimeter surface 181*e* formed vertically and orthogonal to a surface 181*f*, and the chamfer 200*a* extends between the radial perimeter surface 181*e* and the surface 181*f*. And similarly, the stationary bearing housing 122 can also comprise a transition surface, such as a chamfer (e.g., chamfer 200*b*) formed annularly adjacent a lower area of the annular shoulder portion 183 of the stationary bearing housing 122. Thus, a surface 181*g* can be formed orthogonal to the radial perimeter surface 181*c*, and the chamfer 200*b* can extend therebetween. The surface 181*g* of the annular shoulder portion 183 can be seated against the surface 181*f* of shoulder portion 202 when the bearing assembly 102 is inserted into the housing 110, and the chamfers 200*a* and 200*b* can assist in self-alignment of the bearing assembly 102 to the housing 110. That is, the chamfers 200*a* and 200*b* may slide along each other during insertion of the bearing assembly 102 into the housing 110 (if the bearing assembly 102 is laterally and/or vertically misaligned) to facilitate said self-alignment, which is particularly important during the transition between the unlocked position to the locked position so that the stationary bearing housing 122 does not get jammed or bind-up when seated into the housing 110.

These self-alignment features can be advantageous in the face of several potential operational situations. For example, the housing 110 of the RCD 100 may not always be properly vertically disposed as extending from the borehole (e.g., relative to Earth and gravity). Moreover, the bearing assembly 102 may not always be properly aligned with the housing 110 while the bearing assembly 102 is being inserted into the housing 110 via a top drive assembly. Still further, a large amount of spring force can be exerting against each moveable block (e.g., 500 pounds or more for each elastic component), causing the moveable blocks to bind-up or jam against the stationary bearing housing 122 when moving to the locked position. Thus, to account for these considerations, and to properly align and lock the bearing assembly 102 to the housing 110, the chamfers 200*a* and 200*b* are formed, as described above, to help self-align the bearing assembly 102 to the housing 110 when being inserted into the housing 110. Similarly, the chamfers 198*a* and 198*b* are formed, as described above, to vertically guide and self-align the moveable blocks 162*a-c* when transitioning from the unlocked position to the locked position to the stationary bearing housing 122, in case the bearing assembly 102 is not properly vertically aligned with the housing 110.

On either side of chamfer 200*a* of the housing 110, a pair of seals 206*a* and 206*b* may be disposed to prevent mud and other debris from entering areas of the bearing assembly 102.

As discussed above, as the pipe 108 is rotated, the rotary bearing casing 124, the sealing element 134, and the upper sealing assembly 109*a* concurrently rotate about the axis of rotation Y. Such rotational movement can generate inertia sufficient to exert a rotational inertia force on the stationary bearing housing 122 via the tapered bearing assemblies 126*a* and 126*b* that overcomes the locking force provided by the locking block assemblies. Such an inertial force is undesirable because the stationary bearing housing 122 is not designed or intended to rotate, but rather to be locked to the RCD housing 110 to prevent wear or damage on components associated with the RCD housing 110 and the bearing assembly 102.

Figure 9:
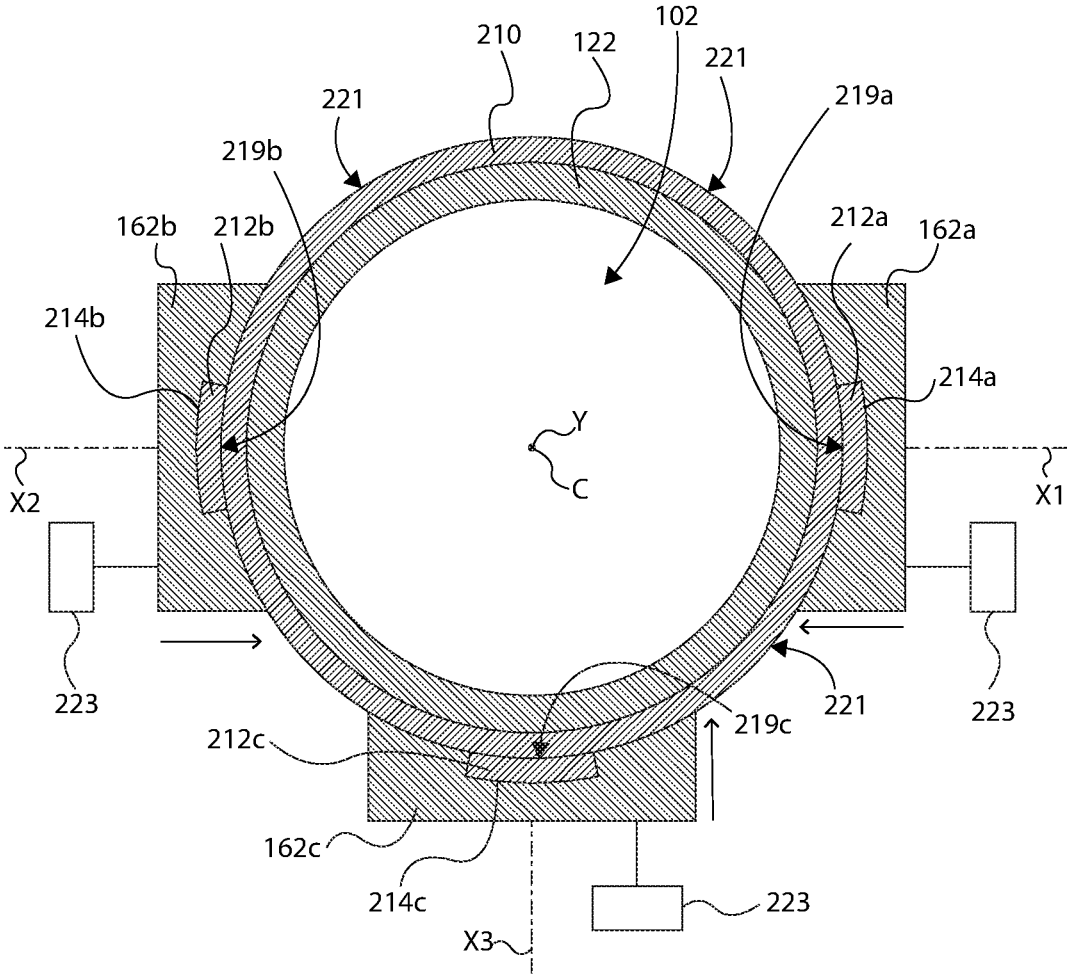
FIG. 9 is a cross-sectional view of the bearing assembly and the locking block system of FIG. 1, taken along lines 9-9 of FIG. 5.

As such, the present disclosure sets forth various example anti-rotation locking systems that function in connection with the locking block assemblies discussed herein to restrict or prevent rotation of (i.e., to lock) the stationary bearing assembly housing 122 of the bearing assembly 102 relative to the RCD housing 110, such as would be required during a drilling operation. The anti-rotation locking systems can be operated with the locking block assemblies, such as those discussed herein, with the anti-rotation locking systems providing a complementary, and more sure lock of the stationary bearing assembly housing 122 to the RCD housing 110 beyond the locking function of the locking block assemblies, namely a lock to prevent relative rotation between these two components. With further reference to FIG. 9, illustrated is an anti-rotation locking system of the RCD 100 in accordance with an example of the present disclosure. Note that FIG. 9 is a lateral cross-sectional view of certain components of FIG. 5, as will be appreciated from the below description.

In the example shown, the RCD can comprise the anti-rotation locking system as discussed herein. The anti-rotation locking system of the RCD can further comprise a locking ring 210 coupled or otherwise secured to the stationary bearing housing 122, such as adjacent an annular flange member (e.g., annular flange member 168), and at least one moveable anti-rotation device (a plurality, or three being shown, namely anti-rotation devices 212*a-c*) operable between a locked position and an unlocked position. Each moveable anti-rotation device 212*a-c* is operable to engage or interface with the locking ring 210, such as when moved to the locked position from the unlocked position, to lock the stationary bearing housing 122 to the RCD housing 110 independent or substantially independent of the rotational position of the stationary bearing housing 122 relative to the RCD housing 110 (i.e., as a result of the bearing assembly 102 being inserted into and locked to the RCD housing 110). Note that the bearing assembly 102 is labeled in an empty space for purposes of illustration clarity, but it should be appreciated that the bearing assembly can/would comprise the necessary components, such as those shown in FIGS. 1-8C.

Although the anti-rotation devices 212*a-c* are shown as being supported on or about the locking block assemblies discussed above (e.g., locking bearing assemblies 120*a-c*, and particularly the moveable blocks 162*a-c*), respectively, this is not intended to be limiting in any way. Indeed, the anti-rotation devices 212*a-c* can be supported on other structures or components designed and operable to move between a locked and unlocked position to engage the locking ring 210. The integration of the anti-rotation devices with the moveable blocks of the locking block assemblies is thus representative of only one example of how the anti-rotation locking system can be implemented. In keeping with the example shown, more specifically, each moveable block 162*a-c* can support thereon (e.g., can be coupled with/to) a respective one of the anti-rotation devices 212*a-c*. For example, each of the anti-rotation devices 212*a-c* can be coupled to one of the moveable blocks 162*a-c* by being inserted into insert portions 214*a-c*, respectively, moveable as shown in FIG. 9. The insert portions 214*a-c* can be formed about an outer portion (e.g., a central outer portion) of the moveable blocks 162*a-c*, respectively, and can be sized and configured to receive and retain the respective moveable anti-rotation devices 212*a-c*. The anti-rotation devices can further comprise at least one engaging portion accessible through the outer portion, and configured to interface with and engage at least one receiving portion of the locking ring. The insert portions 214*a-c* can each have a designed cross-sectional area that corresponds to a similar or matching shape of the respective anti-rotation devices 212*a-c*. In the example shown, the insert portions 214*a-c* and the anti-rotation devices 212*a-c* comprise a trapezoidal shape or configuration. The anti-rotation devices 212*a-c* can be press fit, welded, adhered, or otherwise coupled to the respective moveable blocks 162*a-c*. In another example, each moveable block 162*a-c* can support a plurality of anti-rotation devices along an outer edge of the moveable block 162*a*, for instance, adjacent the shoulder portion 166 (FIG. 6). As such, the single anti-rotation device shown associated with each respective moveable block is not intended to be limiting in any way. Moreover, not every moveable block 162*a-c* will necessarily comprise an anti-rotation device. Indeed, the anti-rotation locking system can comprise any number (e.g., 1, 2, 3, . . . n number) of anti-rotation devices operable to engage and interface with the locking ring 210, regardless of the number of locking block assemblies and associated moveable blocks.

In operation, each moveable anti-rotation device 212*a-c* moves along with the respective moveable blocks 162*a-c* between the locked and unlocked positions, as detailed above regarding the movement and actuation of the locking block assemblies shown in FIGS. 1-8C. As shown with the example moveable block 162*a* in FIG. 6, the shoulder portion 166 can comprise a first interface surface 216 sized and configured to interface with the lower interface surface 181*b* of the annular flange member 168 (see FIG. 8B). The shoulder portion 166 can comprise a second interface surface 218 extending upward (e.g., in an orthogonal direction) from the first interface surface 216 and positioned adjacent the radial surface 181*a* of the annular flange member 168 when in the locked position (FIG. 8B).

In one example locking arrangement of the anti-rotation locking system, the anti-rotation devices 212*a-c* and the locking ring 210 can be configured, and can operate together, as a brake assembly. Specifically, in this example the receiving portion of the locking ring 210 can comprise at least one receiving surface 221. The engaging portions of the respective moveable anti-rotation devices 212*a-c* can comprise at least one friction surface (e.g., see friction surfaces 219*a-c*. In one aspect, the at least one receiving surface 221 can comprise one or more of the outer surfaces of the locking ring 210, such as the outer perimeter surface directly facing the friction surfaces 219*a-c* of the anti-rotation devices (see FIG. 8B). Thus, the friction surfaces 219*a-c* are each configured to interface with a portion of the receiving surface 221 of the locking ring 210, when in the locked position (FIGS. 9 and 8B), to restrict rotation of the stationary bearing housing 122 relative to the RCD housing 110 via a braking force as applied by the brake assembly.

In one example, the friction surfaces 219*a-c* can each be formed of a friction material, or composition of materials, to form a brake pad, which materials or composition of materials can include, but are not limited to, organic materials, synthetic composites, semi-metallic materials, metallic materials, ceramic materials and others as will be apparent to those skilled in the art. The friction surfaces 219*a-c* can be configure to comprise a suitable coefficient of friction (e.g., from 0.35 to 0.42 (or it can vary from such range)).

The locking ring 210, or more particularly its receiving surface 221, can also be comprised of a friction material that can be the same as or different from the friction material of the anti-rotation devices 212*a-c*. For example, the locking ring 210, or its receiving surface 221, or both, can be comprised of composite, ceramic, metal, or other suitable material(s). As such, the locking ring 210 can also comprise a thin layer or surface of similar friction material, such that the receiving surface 221 operates or functions to provide a suitable coefficient of friction to prevent relative rotation between the stationary bearing housing 122 and the RCD housing 110 upon interfacing and interacting with the friction surfaces 219*a-c* when in the locked position. In this manner, a collective frictional force between the moveable anti-rotation devices 212*a-c* and the locking ring 210 can be configured to be greater than an inertia force exerted on the stationary bearing housing 122 upon rotation of the pipe 108 and the rotating components of the bearing assembly 102. Therefore, the stationary bearing housing 122 is restricted from rotation relative to the RCD housing 110 upon moving the moveable blocks 162*a-c*, and the anti-rotation devices 212*a-b*, to the locked position, such that a collective frictional force is generated between the locking ring 210 and the moveable anti-rotation devices 212*a-c*.

In one example, the moveable blocks 162*a-c* can be moved upon the release of potential energy by their respective elastic components (e.g., elastic components 170*a* and 170*b*), as discussed above. The spring force exerted by each elastic component can be designed and configured as needed. For example, in some cases, the elastic component (s) can be configured to exert between 400 and 600 pounds, although this is not intended to be limiting in any way. This spring force biases the respective moveable blocks 162*a-c* inwardly toward the locking ring 210 until each moveable anti-rotation device 212*a-c* contacts and frictionally engages with the locking ring 210, as described above. Then, upon supplying fluid pressure to the moveable blocks 162*a-c*, the anti-rotation devices 212*a-c* are disengaged from or moved away from the locking ring 210, thereby removing the friction force. Some examples of different actuation systems as pertaining to the moveable blocks 162*a-c* is described above.

Alternatively, an actuation system 223 can be coupled to all of the moveable blocks 162*a-c* to actively actuate the moveable blocks 162*a-c* between unlocked and locked positions along their respective axes of translation X1, X2, and X3. The actuation system 223 can comprise a hydraulic actuator, an electric actuator, a pneumatic actuator, and/or other actuators configured to effectuate translational movement of the moveable blocks 162*a-c* along their respective axes of translation between the locked and unlocked positions. In other words, the elastic components and valve devices described above (with reference to FIG. 7A) are not the only ways to operate the frictional anti-rotation locking system described herein. Indeed, other actuation systems are contemplated herein, which could be used to actuate the moveable blocks 162*a-c* between the locked and unlocked positions.

Regardless of the means of actuating the moveable blocks 162*a-c*, the stationary bearing housing 122 can be locked to the RCD housing 110 independent of the rotational position of the stationary bearing housing 122 relative to the RCD housing 110. That is, when the bearing assembly 102 is inserted into the RCD housing 110, the rotational position of the stationary bearing housing 122 may be unknown and/or dynamically changing because the top drive assembly merely picks up and inserts the bearing assembly 102 into the RCD housing 110 without regard to, or exact control over, the rotational position of the stationary bearing housing 122. However, with the present example of the locking block assemblies and the brake-based anti-rotation locking system, the rotational position of the stationary bearing housing 122 is less relevant because the entire outer perimeter surface of the locking ring 210 is a frictional surface (i.e., the receiving surface 221) that can be engaged by the anti-rotation devices 212*a-c* at any position on the locking ring 210 when moved to the locked position. Thus, the rotational position of the stationary bearing housing 122 is independent of the position of the anti-rotation devices 212*a-c* (and the housing 110) because the anti-rotation devices 212*a-c* can contact any part of the receiving surface 221 of the locking ring 210 (collectively and automatically) despite the position of the stationary bearing housing 122 and the attached locking ring 210. This is an advantage over other systems that require human interaction with the bearing assembly (i.e., grabbing/rotating) to clock or position the bearing assembly to a desired position before locking the bearing assembly to the RCD housing, which is time consuming and dangerous to the operators because their hands are prone to injury around the various moving parts associated with the RCD, its bearing assembly, and the top drive.

With continued reference to FIGS. 1-8C, FIGS. 10A-12 illustrate another example of an anti-rotation locking system of an RCD (e.g., 100) for restricting rotation of a bearing assembly 302 (e.g., 102) relative to an RCD housing (e.g., 110) during a drilling operation. In this example, the anti-rotation locking system of an RCD as discussed herein. The anti-rotation locking system of the RCD can further comprise a locking ring 310 coupled to or otherwise secured to the stationary bearing housing 122, such as adjacent an annular flange member (e.g., annular flange member 168), and at least one anti-rotation device (a plurality, or three being shown, namely anti-rotation devices 312*a-c*) operable between a locked position and an unlocked position, as detailed below. Each anti-rotation device 312*a-c* is operable to engage or interface with the locking ring 310, such as when moved to the locked position from the unlocked position, to lock the stationary bearing housing 122 of the bearing assembly 102 to the RCD housing 110 (FIG. 1) substantially independent of the rotational position of the stationary bearing housing 122 relative to the RCD housing 110 (i.e., as a result of the bearing assembly 102 being inserted into and locked to the RCD housing 110).

Although the anti-rotation devices 312*a-c* are shown as being supported on or about the locking block assemblies 320*a-c*, which are similar to the locking block assemblies discussed above (e.g., locking bearing assemblies 120*a-c*, and particularly the moveable blocks 162*a-c*), respectively, this is not intended to be limiting in any way. Indeed, the anti-rotation devices 312*a-c* can be supported on other structures or components designed and operable to move between a locked and unlocked position to engage the locking ring 210. The integration of the anti-rotation devices 312*a-c* with the moveable blocks 362*a-c* of the locking block assemblies 320*a-c* is thus representative of only one example of how the anti-rotation locking system can be implemented. In keeping with the example shown, the plurality of locking block assemblies 320*a-c* (e.g., which are similar to locking block assemblies 120*a-c* discussed above) can comprise respective moveable blocks 362*a-c* (e.g., similar to moveable blocks 162*a-c* discussed above) that support thereon (e.g., can be coupled with/to) a respective one of the anti-rotation devices 312*a-c*. For example, each of the anti-rotation devices 312*a-c* can be coupled to one of the moveable blocks 362*a-c* by being inserted into insert portions of each moveable block 362*a-c* (e.g., see insert portion 314*a* of moveable block 162*a*). The insert portions can be formed about an outer portion (e.g., a central outer portion) of the moveable blocks 362*a-c*, respectively, and can be sized and configured to receive and retain respective moveable anti-rotation devices 312*a-c*. The anti-rotation devices 312*a-c* can further comprise at least one engaging portion accessible through the outer portion, and configured to interface with and engage at least one receiving portion of the locking ring 310.

The insert portions 314*a-c* can each have a designed cross-sectional area that corresponds to a similar or matching shape of the respective anti-rotation devices 312*a-c*. In the example shown, the insert portions 314*a-c* and the anti-rotation devices 312*a-c* comprise a trapezoidal shape or configuration. The anti-rotation devices 312*a-c* can be press fit, welded, adhered, or otherwise coupled to the respective moveable blocks 362*a-c*. In another example, each moveable block 362*a-c* can support a plurality of anti-rotation devices along an outer edge of the moveable block 362*a*, for instance, adjacent the shoulder portion 366 (FIG. 6). As such, the single anti-rotation device shown associated with each respective moveable block is not intended to be limiting in any way. Moreover, not every moveable block 362*a-c* will necessarily comprise an anti-rotation device. Indeed, the anti-rotation locking system can comprise any number (e.g., 1, 2, 3, . . . n number) of anti-rotation devices operable to engage and interface with the locking ring 310, regardless of the number of locking block assemblies and associated moveable blocks.

Figure 11:
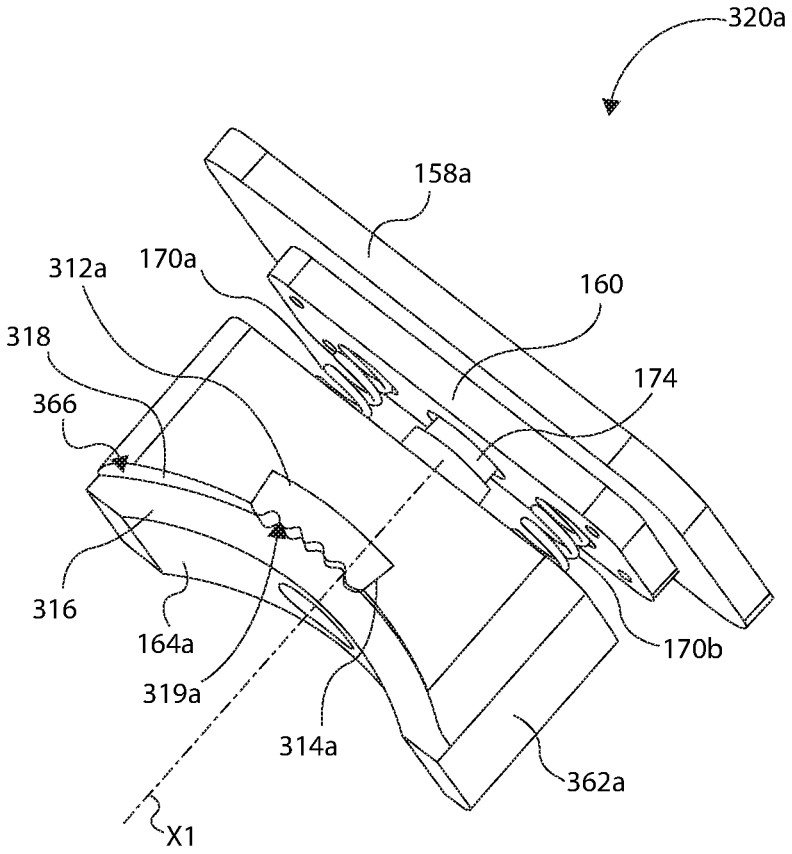
FIG. 11 is an isometric view of a movable block of a locking block assembly of the RCD of FIG. 1, comprising the anti-rotation locking system of FIG. 10A.

In operation, each moveable anti-rotation device 312*a-c* moves along with the respective moveable block 362*a-c* between the locked and unlocked positions, as detailed above in one example regarding moveable blocks 162*a-c*. As shown in FIG. 11, each moveable block (as exemplified by moveable block 362*a*) can have the same or similar features as the example moveable blocks 162*a-c* discussed above. Thus, in the example of the moveable block 362*a*, it can comprise a shoulder portion 366 comprising a first interface surface 316 interfaced to the lower interface surface 181*b* of the annular flange member 168 (e.g., FIG. 8B), and a second interface surface 318 extending from the first interface surface 316 and interfaced to the radial perimeter surface 181*a* of the annular flange member 168.

In another example of a locking arrangement of the anti-rotation locking system, the anti-rotation devices 312*a-c* and the locking ring 310 can be configured, and can operate together, as a gear assembly. Specifically, in this example, the receiving portion of the locking ring 310 can comprise a plurality of geared teeth 321. Likewise, the engaging portions of the respective anti-rotation devices 312*a-c* can comprise a plurality of gear teeth formed therein (e.g., see gear teeth 319*a* in FIG. 10B) moveable configured to mate and engage with at least some of the geared teeth 321 of the locking ring 310 (such as with a gear/pinion interface). As shown, the geared teeth 321 can be formed around the entire perimeter of the locking ring 310. All the gear teeth associated with the anti-rotation locking system can comprise a suitable tooth geometry or nomenclature, such as spur gear teeth, Wildhaber-Novikov teeth, and other suitable geared configurations.

Figure 10B:
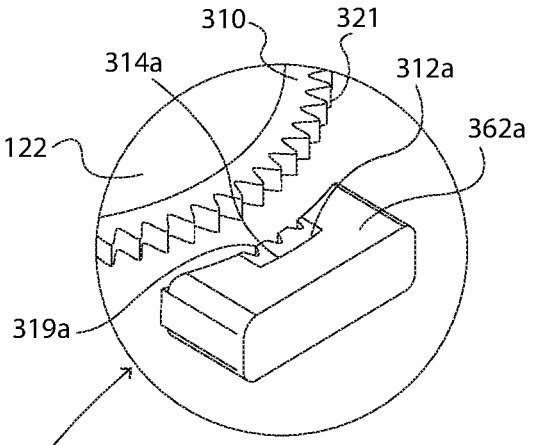
FIG. 10B is detailed view of the identified portion of FIG. 10A.
Figure 10A:
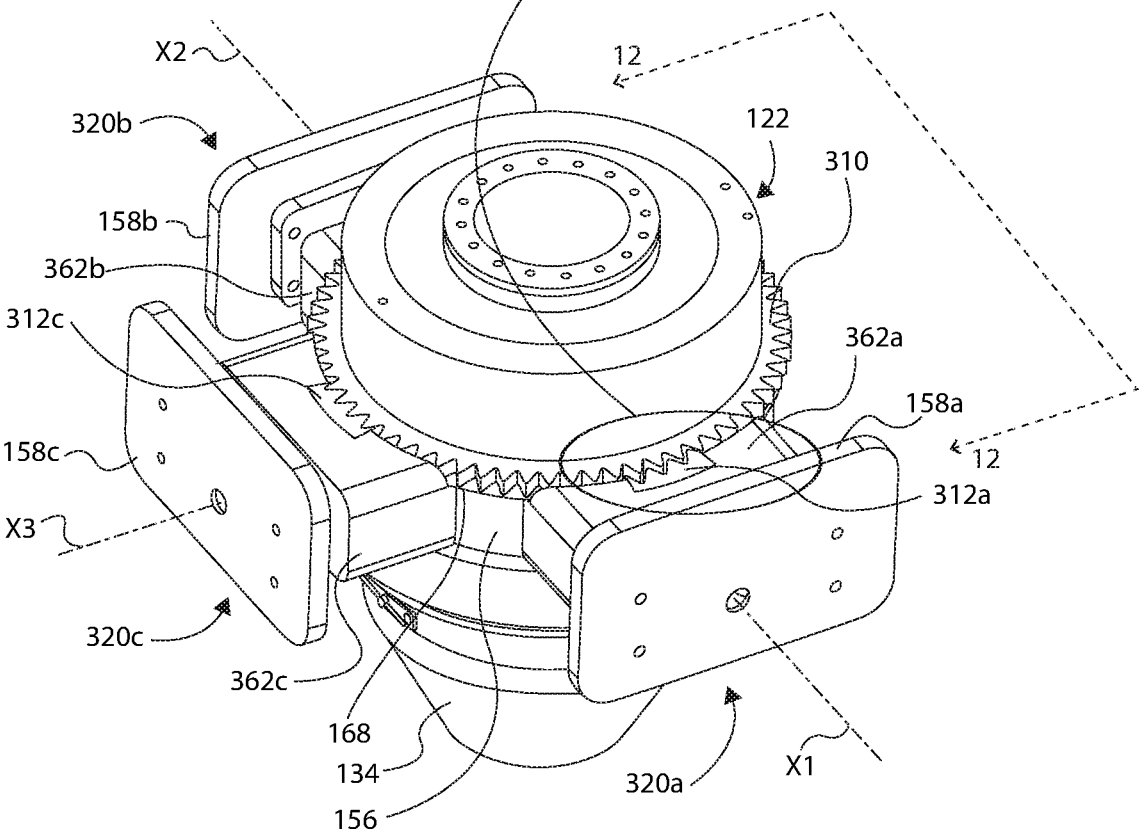
FIG. 10A is an isometric view of a portion of the bearing assembly and locking block system of FIG. 1, the locking block system comprising an anti-rotation locking system in accordance with another example.
Figure 12:
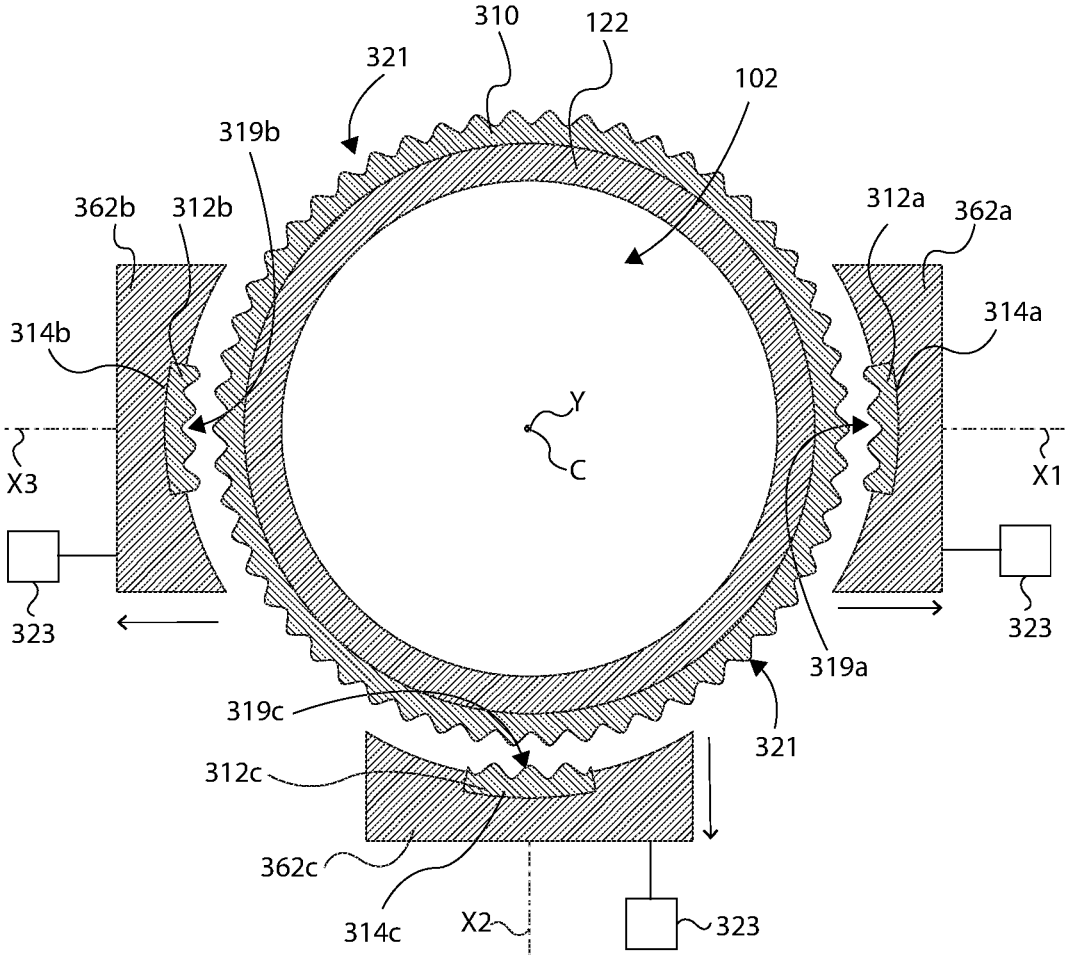
FIG. 12 is a cross-sectional view of certain components of the anti-rotation locking system of FIG. 10A taken along lines 12-12.

In this example, the teeth 319*a-c* of the anti-rotation devices 312*a-c* are configured to interface with the geared teeth 321 of the locking ring 310, when in the locked position (FIG. 10A), to restrict rotation of the stationary bearing housing 122 relative to the RCD housing 110. In this manner, a locking force between the anti-rotation devices 312*a-c* and the locking ring 310 is greater than an induced rotational inertia force exerted on the bearing assembly 102 upon rotation of the pipe 108 and the rotating components of the bearing assembly 102. Therefore, the stationary bearing housing 122 is restricted from rotation relative to the housing 110 upon movement of the moveable blocks 362*a-c*, and the coupled anti-rotation devices 312*a-b*, to the locked position. Note that FIGS. 10B and 12 show unlocked positions for purposes of illustration, and FIG. 10B shows only a front-half portion of the moveable block 362*a* for illustration.

In one example, the moveable blocks 362*a-c* can be moved upon the release of potential energy by the elastic components 170*a* and 170*b*, as discussed above. Such spring force biases the respective moveable blocks 362*a-c* inwardly toward the locking ring 310 until each anti-rotation device 312*a-c* contacts and engages with the locking ring 310 (in this case, via the gear assembly). Then, upon supplying fluid pressure to the moveable blocks 362*a-c* (e.g., in the same or similar manner as described above regarding moveable blocks 162*a-c*), the anti-rotation devices 312*a-c* can be disengaged or moved away from the locking ring 310, thereby removing the locking force. Alternatively, an actuation system 323 can be coupled to each moveable block 362*a-c* to actively actuate the moveable blocks 362*a-c* between unlocked and locked positions, such as described regarding FIG. 9.

Advantageously, the stationary bearing housing 322 can be locked to the RCD housing 110 independent of the rotational position of the stationary bearing housing 122 relative to the RCD housing 110. That is, when the bearing assembly 102 is inserted into the RCD housing 110, the rotational position of the stationary bearing housing 122 may be unknown or variable because the top drive assembly merely picks up and inserts the bearing assembly 102 into the RCD housing 110 without regard to the rotational position of the stationary bearing housing 122. However, with the present example of the locking block assemblies and the gear type of anti-rotation locking system, the rotational position of the stationary bearing housing 122 is less relevant because the entire perimeter of the locking ring 310 comprises geared teeth configured to engage with any of the teeth of each of the anti-rotation devices 312*a-c* when moved to the locked position. Thus, the rotational position of the stationary bearing housing 122 is independent of the position of the anti-rotation devices 312*a-c* and the housing 110 because the anti-rotation devices 312*a-c* can contact any portion of the locking ring 310 (collectively and automatically), despite the position of the stationary bearing housing 122 and the attached locking ring 310. This provides advantages similar to those discussed herein.

With continued reference to FIGS. 1-8C, FIGS. 13A-15 illustrate another example of an anti-rotation locking system of an RCD for restricting rotation of the stationary bearing housing 122 of the bearing assembly 102 relative to the RCD housing 110 during a drilling operation. In this example, the anti-rotation locking system of the RCD as discussed herein. The anti-rotation locking system can further comprise a locking ring 410 coupled to or otherwise secured to the stationary bearing housing 122, such as adjacent an annular flange member (e.g., annular flange member 168), and at least one anti-rotation device (a plurality, or three being shown, namely anti-rotation devices 412*a-c*) operable between a locked position and an unlocked position, as detailed below. Each anti-rotation device 412*a-c* is operable to engage or interface with the locking ring 410, such as when moved to the locked position from the unlocked position, to lock the stationary bearing housing 122 of the bearing assembly 102 to the RCD housing 110 (FIG. 1) substantially independent of the rotational position of the stationary bearing housing 122 relative to the RCD housing 110 (i.e., as a result of the bearing assembly 102 being inserted into and locked to the RCD housing 110).

Although the anti-rotation devices 412*a-c* are shown as being supported on or about the locking block assemblies 420*a-c*, which are similar to the locking block assemblies discussed above (e.g., locking bearing assemblies 120*a-c*, and particularly the moveable blocks 162*a-c*), respectively, this is not intended to be limiting in any way. Indeed, the anti-rotation devices 412*a-c* can be supported on other structures or components designed and operable to move between a locked and unlocked position to engage the locking ring 410. The integration of the anti-rotation devices 412*a-c* with the moveable blocks 462*a-c* of the locking block assemblies 420*a-c* is thus representative of only one example of how the anti-rotation locking system can be implemented. In keeping with the example shown, the plurality of locking block assemblies 420*a-c* (e.g., which are similar to locking block assemblies 120*a-c* discussed above) can comprise respective moveable blocks 462*a-c* (e.g., similar to moveable blocks 162*a-c*, also discussed above) that support thereon (e.g., can be coupled with/to) a respective one of the anti-rotation devices 412*a-c*. For example, each of the anti-rotation devices 412*a-c* can be coupled to one of the moveable blocks 462*a-c* by being inserted into insert portions of each moveable block 462*a-c* (e.g., see insert portion 414*a* of moveable block 162*a*). The insert portions 414*a-c* can be formed about an outer portion (e.g., a central outer portion) of the moveable blocks 462*a-c*, respectively, and can be sized and configured to receive and retain respective anti-rotation devices 412*a-c*. The anti-rotation devices 412*a-c* can further comprise at least one engaging portion accessible through the outer portion, and configured to interface with and engage at least one receiving portion of the locking ring 410.

Figure 14:
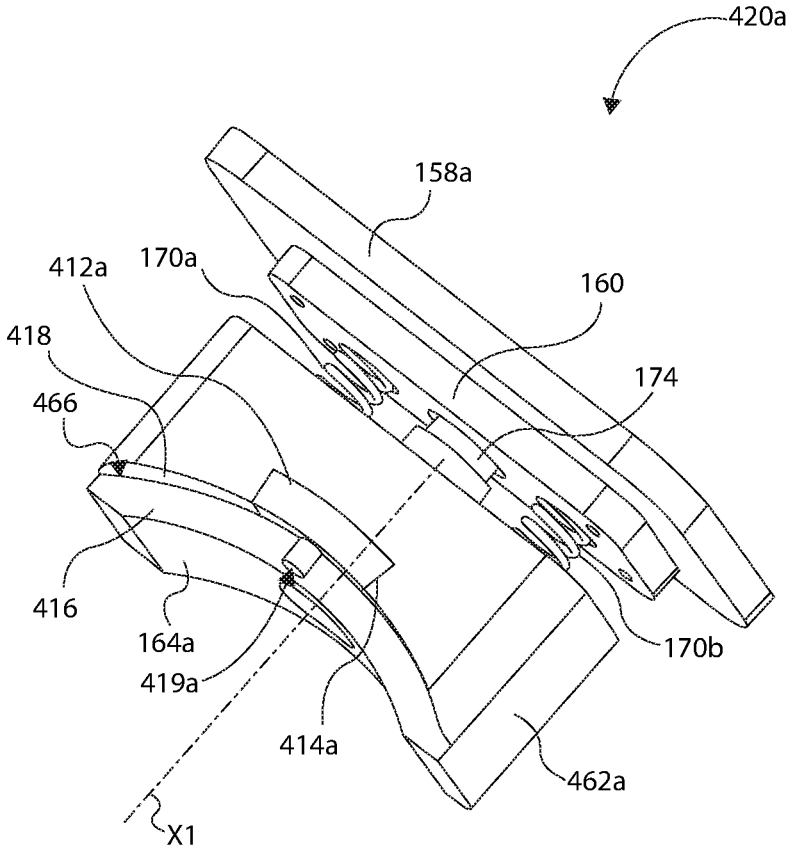
FIG. 14 is an isometric view of a movable block of a locking block assembly of the RCD of FIG. 1, comprising the anti-rotation locking system of FIG. 13A.

Each moveable anti-rotation device 412*a-c* moves along with the supporting respective moveable block 462*a-c* between the locked and unlocked positions, as detailed above in one example regarding moveable blocks 162*a-c*. As shown in FIG. 14, each moveable block (as exemplified by moveable block 462*a*) can have the same or similar features as the example moveable blocks 162*a-c* discussed above. Thus, in the example of moveable block 462*a*, it can comprise a shoulder portion 466 comprising a first interface surface 416 interfaced to the lower interface surface 181*b* of the annular flange member 168 (e.g., FIG. 8B), and a second interface surface 418 extending from the first interface surface 216 and disposed adjacent to the first radial perimeter surface 181*a* of the annular flange member 168.

The insert portions 314*a-c* can each have a designed cross-sectional area that corresponds to a similar or matching shape of the respective anti-rotation devices 312*a-c*. In the example shown, the insert portions 314*a-c* and the anti-rotation devices 312*a-c* comprise a trapezoidal shape or configuration. The anti-rotation devices 312*a-c* can be press fit, welded, adhered, or otherwise coupled to the respective moveable blocks 362*a-c*. In another example, each moveable block 362*a-c* can support a plurality of anti-rotation devices along an outer edge of the moveable block 362*a*, for instance, adjacent the shoulder portion 366 (FIG. 6). As such, the single anti-rotation device shown associated with each respective moveable block is not intended to be limiting in any way. Moreover, not every moveable block 362*a-c* will necessarily comprise an anti-rotation device. Indeed, the anti-rotation locking system can comprise any number (e.g., 1, 2, 3, . . . n number) of anti-rotation devices operable to engage and interface with the locking ring 310, regardless of the number of locking block assemblies and associated moveable blocks.

In operation, each moveable anti-rotation device 412*a-c* moves along with the respective moveable block 462*a-c* between the locked and unlocked positions, as detailed above in one example regarding moveable blocks 162*a-c*. As shown in FIG. 14, each moveable block (as exemplified by moveable block 462*a*) can have the same or similar features as the example moveable blocks 162*a-c* discussed above. Thus, in the example of the moveable block 462*a*, it can comprise a shoulder portion 466 comprising a first interface surface 416 interfaced to the lower interface surface 181*b* of the annular flange member 168 (e.g., FIG. 8B), and a second interface surface 418 extending from the first interface surface 416 and interfaced to the radial perimeter surface 181*a* of the annular flange member 168.

In another example of a locking arrangement of the anti-rotation locking system, the anti-rotation devices 412*a-c* and the locking ring 410 can be configured, and can operate together, as a pin lock assembly, or pinned assembly. Specifically, in this example, the receiving portion of the locking ring 410 can comprise a plurality of perimeter openings 421 formed therein, and each anti-rotation device 412*a-c* can include a locking pin 419*a-c* sized to interface or engage with one opening of the perimeter openings 421 of the locking ring 410 when transitioning to the locked position. Each locking pin 419*a-c* can be a cylindrically shaped (or any other shaped) protrusion extending toward the locking ring 410, and each of the perimeter openings 421 can be a bore of the same cross-sectional shape formed radially through and around the entire perimeter of the locking ring 410.

Figure 13B:
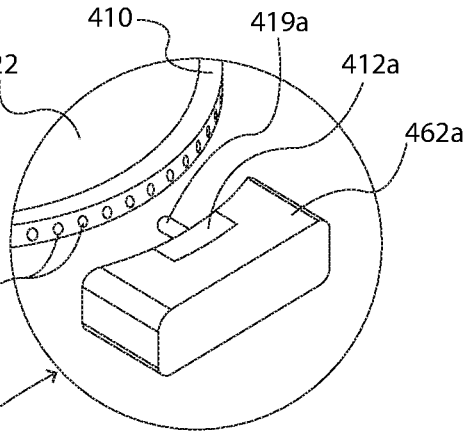
FIG. 13B is detailed view of the identified portion of FIG. 13A.
Figure 13A:
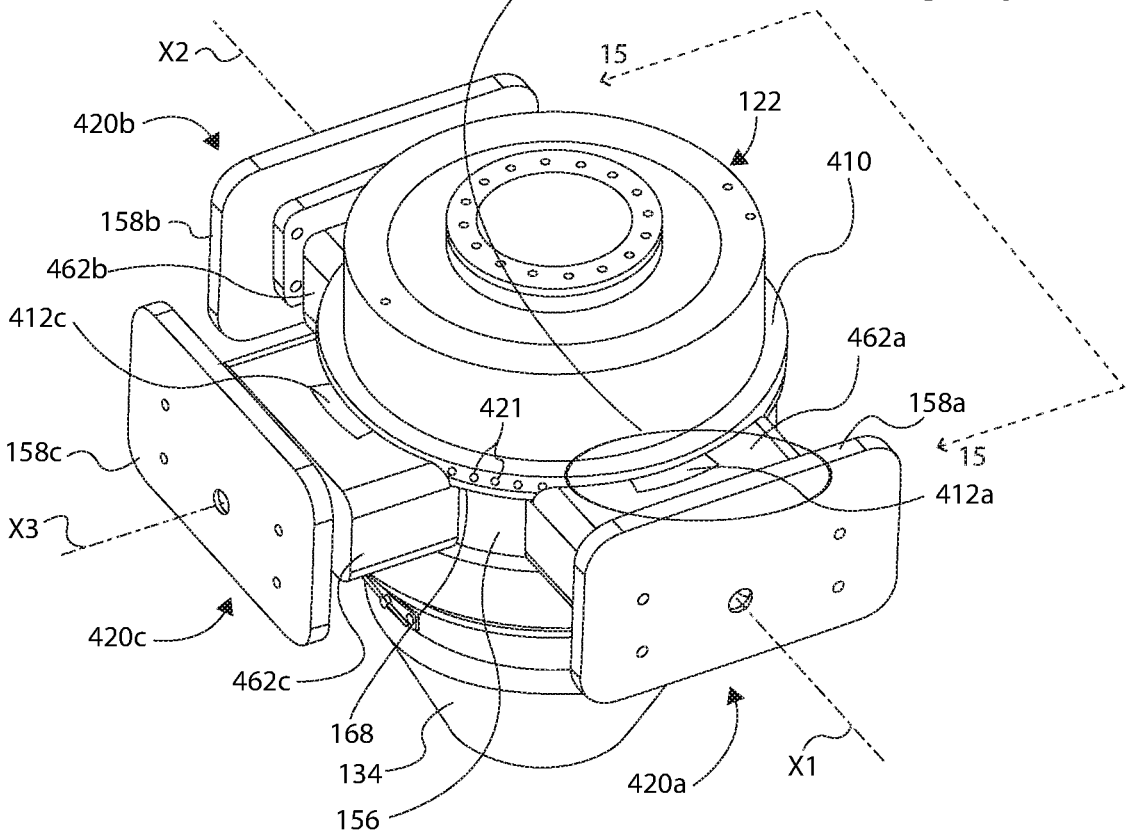
FIG. 13A is an isometric view of a portion of a bearing assembly, the locking block assembly comprising an anti-rotation locking system in accordance with another example.
Figure 15:
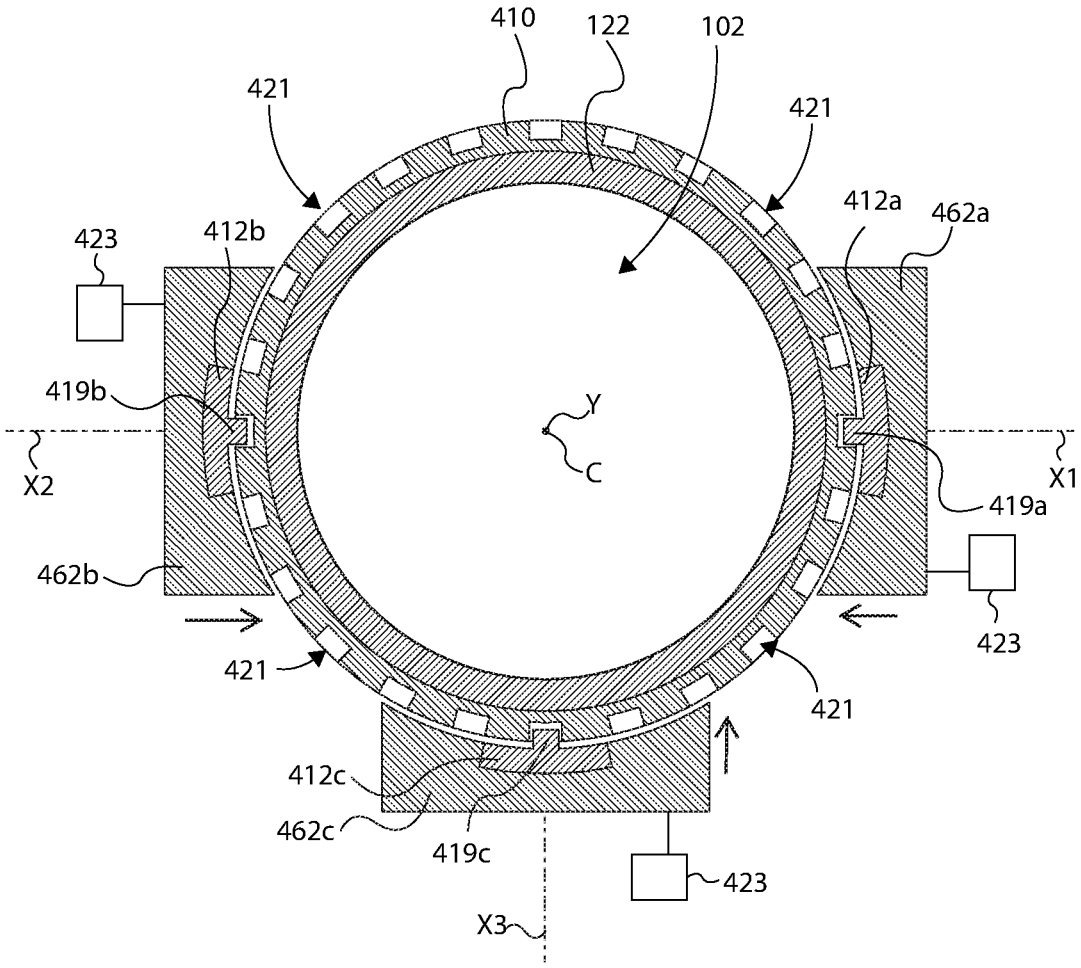
FIG. 15 is a cross-sectional view of certain components of the anti-rotation locking system FIG. 13A taken along lines 15-15.

The perimeter openings 421 can be sized slightly larger than the locking pins 419*a-c* to facilitate proper engagement, as shown in FIG. 15. Therefore, the locking pins 419*a-c* of each of the anti-rotation devices 412*a-c* are configured to interface with the openings of the perimeter openings 421 of the locking ring 410, when in the locked position, to restrict rotation of the stationary bearing housing 422 relative to the RCD housing 110. In this manner, a locking force between the moveable anti-rotation devices 420*a-c* and the locking ring 410 is greater than a rotational inertia force exerted to the stationary bearing housing 122 upon rotation of the pipe 108 and the rotating components of the bearing assembly 102. Therefore, the stationary bearing housing 122 is restricted from rotation relative to the housing (e.g., 110) upon movement of the moveable blocks 462*a-c*, and the coupled anti-rotation devices 412*a-b*, to the locked position. Note that FIG. 13B shows the unlocked position, and only a front-half portion of the moveable block 462*a*, for purposes of illustration.

In one example, the moveable blocks 462*a-c* can be moved upon the release of potential energy by the elastic components 170*a* and 170*b*, as discussed above. Such spring force biases the respective moveable blocks 462*a-c* inwardly toward the locking ring 410 until each moveable anti-rotation device 412*a-c* engages with the locking ring 410 (in this case via the pin lock assembly). Then, upon supplying fluid pressure to the moveable blocks 462*a-c* (e.g., in the same or similar manner as described above), the anti-rotation devices 412*a-c* can be moved away from the locking ring 410, thereby removing any locking force. Alternatively, an actuation system 423 can be coupled to each moveable block 462*a-c* to actively actuate the moveable blocks 462*a-c* between unlocked and locked positions, such as described regarding FIG. 9.

Advantageously, the stationary bearing housing 122 can be locked to the housing 110 independent of the rotational position of the stationary bearing housing 122 relative to the housing 110. That is, when the bearing assembly 102 is inserted into the housing 110, the rotational position of the stationary bearing housing 122 may be unknown or dynamically changing because the top drive assembly merely picks up and inserts the bearing assembly 102 into the housing 110 without regard to the rotational position of the stationary bearing housing 122. However, with the present example of the locking block assemblies and the pin lock type of anti-rotation locking system, the rotational position of the stationary bearing housing 122 is less relevant because the entire perimeter of the outer surface of the locking ring 410 comprises numerous openings each configured to be engaged by respective locking pins 419*a-c* of the anti-rotation devices 412*a-c* when moved to the locked position. Thus, the rotational position of the stationary bearing housing 122 is substantially independent of the position of the anti-rotation devices 412*a-c* because their locking pins 419*a-c* can engage with any opening of the locking ring 410 (collectively and automatically), despite the position of the stationary bearing housing 122 and the attached locking ring 410. This is because the pipe 108 may be rotating the bearing assembly 102 as it is being inserted into the housing 110, so that the locking ring 410 and its perimeter openings 421 would be slowly rotating as the moveable blocks 462*a-c* are moving to the locked position. In this manner, the pins 419*a-c* will eventually interface with and engage an opening of the perimeter openings 421.

In an alternative example, the perimeter openings in the locking ring 410 described regarding FIG. 15 can instead be formed vertically from above (and around) the locking ring 410 (instead of being radially formed). Thus, one or more locking pins can be configured to vertically engage with said vertical perimeter openings when in the locked position. In this manner, a separate pin actuation mechanism can be coupled to the housing 110, which can be manually or automatically operated to vertically insert and remove the locking pins about the openings of said perimeter openings. In another aspect, a separate pin actuation linkage can be coupled to the moveable blocks such that, upon moving the moveable blocks to the locked position, the vertically oriented pins automatically engage with an opening of the vertical perimeter openings of the locking ring.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A rotating control device (RCD) having an anti-rotation locking system for restricting rotation of a bearing assembly housing of the RCD, comprising:

an RCD housing operable with a blowout preventer;

a bearing assembly operable to be received within the RCD housing and comprising a stationary bearing housing, the bearing assembly configured to receive and engage with and seal a pipe of a drill string of a drill rig, a locking ring secured to the stationary bearing housing and extending radially from the stationary bearing housing;

a locking block assembly supported by the RCD housing, the locking block assembly comprising a moveable block operable between a locked position that locks the bearing assembly to the RCD housing and an unlocked position, and at least one elastic component situated between the RCD housing and the moveable block, the elastic component being configured to bias the moveable block in the locked position by default; and an anti-rotation device supported by the locking block assembly, the anti-rotation device comprising at least one locking ring engaging portion operable to engage the locking ring to provide a complementary, anti-rotation lock when the locking block assembly is in the locked position, to lock rotation of the stationary bearing housing to the RCD housing independent of the rotational position of the stationary bearing housing relative to the RCD housing.

2. The RCD of claim 1, wherein the stationary bearing housing comprises an annular flange member, and wherein the locking ring is secured to the bearing assembly adjacent the annular flange member.

3. The RCD of claim 1, wherein the moveable block comprises an insert portion operable to receive and retain the anti-rotation device.

4. The RCD of claim 3, wherein the insert portion is formed through an outer portion of the moveable block, and wherein the least one engaging portion is accessible through the outer portion, and configured to interface with and engage at least one receiving portion of the locking ring.

5. The RCD of claim 4, wherein the engaging portion comprises at least one friction surface formed of a friction material, and wherein the receiving portion comprises at least one receiving surface operable to interface and engage with the friction surface of the anti-rotation device, in the locked position, such that the anti-rotation device and the locking ring are operable together as a brake assembly.

6. The RCD of claim 4, wherein the engaging portion of the anti-rotation device comprises a plurality of gear teeth, and wherein the receiving portion of the locking ring comprises a plurality of gear teeth operable to interface with and mate with the gear teeth of the anti-rotation device, in the locked position, such that the anti-rotation device and the locking ring are operable together as a gear assembly.

7. The RCD of claim 4, wherein the engaging portion of the anti-rotation device comprises a pin, and wherein the receiving portion of the locking ring comprises a plurality of apertures formed radially about the locking ring within an outer surface, each aperture operable to interface with and receive the pin of the anti-rotation device, in the locked position, such that the anti-rotation device and the locking ring are operable together as a pin lock assembly.

8. The RCD of claim 1, wherein the anti-rotation locking system comprises a plurality of anti-rotation devices, each operable to engage the locking ring at different locations, when in the locked position.

9. The RCD of claim 8, further comprising a plurality of locking block assemblies supported by the RCD housing and operable between the locked position and the unlocked position, each of the locking block assemblies comprising a moveable block that support thereon at least one of the plurality of anti-rotation devices.

10. The RCD of claim 8, wherein the plurality of anti-rotation devices and the locking ring are configured as a brake assembly, a gear assembly, a pin lock assembly, or any combination of these.

11. The RCD of claim 1, wherein the stationary bearing housing comprises an annular recess and the moveable block comprises a channel interface surface having a radial configuration that corresponds to a radial surface of the annular recess with the moveable block in the locked position.

12. A method for restricting rotation of a bearing assembly housing of a bearing assembly of an rotating control device (RCD) of a drilling rig, the method comprising:

operating an RCD coupled to a blowout preventer of a drill rig, the RCD comprising:

an RCD housing operable with the blowout preventer;

a bearing assembly receivable into the RCD housing and operable to receive a pipe of a drill string, the bearing assembly comprising a stationary bearing housing;

a locking block assembly supported by the RCD housing, the locking block assembly comprising a moveable block operable between a locked position that locks the bearing assembly to the RCD housing and an unlocked position;

a locking ring secured to the stationary bearing housing of the bearing assembly;

a plurality of anti-rotation devices supported by the RCD housing, the plurality of anti-rotation devices comprising at least one locking ring engaging portion operable between a locked position where the locking ring engaging portion engages the locking ring to lock rotation of the bearing assembly within the RCD housing, and an unlocked position;

operating an anti-rotation locking system to move the plurality of anti-rotation devices to the unlocked position;

operating a locking block system to move the moveable block to an unlocked position;

inserting the bearing assembly into the RCD housing with the locking block assembly and the plurality of anti-rotation devices in the unlocked position operating the locking block system to move the moveable block to the locked position to lock the stationary bearing housing to the RCD housing; and operating the anti-rotation locking system to lock the rotation of the stationary bearing housing, wherein the anti-rotation devices move from the unlocked position to the locked position and engage the locking ring, thereby restricting rotation of the stationary bearing housing relative to the RCD housing, the anti-rotation devices engaging the locking ring independent of the rotational position of the stationary bearing housing relative to the RCD housing.

13. The method of claim 12, wherein operating the anti-rotation locking system comprises engaging a friction surface of at least one of the anti-rotation devices with a receiving surface of the locking ring.

14. The method of claim 12, wherein operating the anti-rotation locking system comprises engaging gear teeth of at least one of the anti-rotation devices with gear teeth of the locking ring.

15. The method of claim 12, wherein operating the anti-rotation locking system comprises engaging a pin of at least one of the anti-rotation devices with one of a plurality of apertures formed on the locking ring.

16. The method of claim 12, further comprising supporting the anti-rotation devices about respective moveable blocks as part of respective locking block assemblies, one of which comprises the locking block assembly, of the RCD housing, such that operation of the locking block assemblies and movement of the moveable blocks moves the anti-rotation devices between the locked and unlocked positions.

17. The method of claim 16, wherein the moveable blocks are biased in the locked position, the method further comprising overcoming the biasing force to move the moveable blocks and any associated anti-rotation devices to the unlocked position by actuating an actuator assembly associated with the locking block assemblies to apply a fluid pressure to the moveable blocks.

18. The method of claim 17, further comprising deactivating the actuator assembly to remove the fluid pressure from the moveable blocks, wherein the biasing force automatically moves the moveable blocks and the anti-rotation devices to the locked position.

19. A method for operating a rotating control device (RCD) of a drill rig, the method comprising:

operating an RCD coupled to a blowout preventer of a drill rig, the RCD comprising:

an RCD housing operable with the blowout preventer;

a bearing assembly receivable into the RCD housing and operable to receive a pipe of a drill string;

a plurality of locking block assemblies supported by the RCD housing, each locking block assembly having a moveable block biased in a locked position by default;

a plurality of anti-rotation devices supported by the locking block assemblies, the plurality of anti-rotation devices each comprising at least one locking ring engaging portion;

applying an actuation force to the moveable blocks to move the moveable blocks to an unlocked position;

selectively maintaining the moveable blocks in the unlocked position by maintaining application of the actuation force on the moveable blocks;

inserting the bearing assembly into the RCD housing, the bearing assembly comprising a stationary bearing housing and a locking ring secured to the stationary bearing housing; and removing the actuation force to cause the moveable blocks to transition from the unlocked position to the locked position, such that the locking block assemblies engage with the stationary bearing housing to lock the stationary bearing housing to the RCD housing and the plurality of anti-rotation devices interface with and engage the locking ring to lock rotation of the stationary bearing housing relative to the RCD housing.

* * * * *